US012305642B2

(12) United States Patent
Lee et al.

(10) Patent No.: US 12,305,642 B2
(45) Date of Patent: May 20, 2025

(54) ROTARY COMPRESSOR

(71) Applicant: LG ELECTRONICS INC., Seoul (KR)

(72) Inventors: Minho Lee, Seoul (KR); Yongkyu Choi, Seoul (KR); Bumdong Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/714,172

(22) PCT Filed: Jul. 5, 2022

(86) PCT No.: PCT/KR2022/009688
§ 371 (c)(1),
(2) Date: May 29, 2024

(87) PCT Pub. No.: WO2023/101123
PCT Pub. Date: Jun. 8, 2023

(65) Prior Publication Data

US 2025/0035113 A1 Jan. 30, 2025

(30) Foreign Application Priority Data

Nov. 30, 2021 (KR) ..... 10-2021-0169213

(51) Int. Cl.

| | |
|---|---|
| ***F04C 18/34*** | (2006.01) |
| ***F04C 18/344*** | (2006.01) |
| ***F04C 18/356*** | (2006.01) |
| ***F04C 29/00*** | (2006.01) |
| ***F04C 29/02*** | (2006.01) |

(52) U.S. Cl.
CPC ..... *F04C 18/3441* (2013.01); *F04C 29/028* (2013.01); *F04C 2240/50* (2013.01)

(58) Field of Classification Search
CPC ..... F04C 18/344; F04C 18/356; F04C 29/02; F04C 29/00
See application file for complete search history.

(56) References Cited

U.S. PATENT DOCUMENTS

| | | | | |
|---|---|---|---|---|
| 4,086,040 | A * | 4/1978 | Shibuya | F04C 29/02 418/82 |
| 2018/0223844 | A1 * | 8/2018 | Moon | F04C 29/12 |

FOREIGN PATENT DOCUMENTS

| | | |
|---|---|---|
| JP | 04-041988 | 8/1993 |
| JP | 07-317676 | 12/1995 |

(Continued)

OTHER PUBLICATIONS

International Search Report dated Dec. 6, 2022 issued in Application No. PCT/KR2022/009688.

*Primary Examiner* — Deming Wan
(74) *Attorney, Agent, or Firm* — KED & ASSOCIATES

(57) ABSTRACT

In a rotary compressor, at least any one of a main bearing or a sub-bearing may have at least one axial-direction support portion that extends from an outer circumferential surface of a back pressure pocket and is formed to have a predetermined depth. The compressor may increase an oil film pressure that supports a roller in an axial direction thereof to stably support the roller including a rotational shaft in the axial direction, thereby effectively suppressing or preventing friction loss and abrasion between the roller and the main bearing facing the roller and between the roller and the sub-bearing.

23 Claims, 13 Drawing Sheets

(56) References Cited

FOREIGN PATENT DOCUMENTS

| | | |
|---|---|---|
| JP | 2015-137576 | 7/2015 |
| JP | 2016-003606 | 1/2016 |
| JP | 6760836 | 9/2020 |
| KR | 10-2014-0011077 | 1/2014 |
| KR | 10-2191124 | 12/2020 |

* cited by examiner

ROTARY COMPRESSOR

CROSS-REFERENCE TO RELATED APPLICATIONS

This application is the National Stage filing under 35 U.S.C. 371 of International Application No. PCT/KR2022/009688, filed on Jul. 5, 2022, which claims the benefit of earlier filing date and right of priority to Korean Patent Application No. 10-2021-0169213, filed on Nov. 30, 2021, the contents of which are all hereby incorporated by reference herein in their entirety.

TECHNICAL FIELD

The present disclosure relates to a rotary compressor that compresses refrigerant while a roller disposed on a rotational shaft rotates in a cylinder.

BACKGROUND ART

Rotary compressors may be classified according to the way a roller rotates relative to a cylinder. For example, rotary compressors may be classified into an eccentric rotary compressor in which a roller rotates eccentrically with respect to a cylinder, and a concentric rotary compressor in which a roller rotates concentrically with respect to a cylinder.

Rotary compressors may be classified according to a method of dividing a compression space. For example, rotary compressors may be classified into a vane rotary compressor in which a vane is brought into contact with a roller or a cylinder to divide a compression space, and an elliptical rotary compressor in which a portion of an elliptical roller is brought into contact with a cylinder to divide a compression space.

The rotary compressor includes a drive motor. A rotational shaft is coupled to a rotor of the drive motor and transmits rotational force of the drive motor to a roller through the rotational shaft, so as to compress refrigerant.

Patent Document 1 (Japanese Patent Laid-Open No. 04-041988) discloses a vane rotary compressor as well as an eccentric rotary compressor. The rotary compressor disclosed in Patent Document 1 is a two-stage rotary compressor in which two cylinders are disposed on one rotational shaft along an axial direction, and is also a vertical rotary compressor in which the rotational shaft is perpendicular to the ground. This rotary compressor has a thrust plate on a sub bearing adjacent to a lower oil storage space to support an axial lower end of the rotational shaft.

Patent Document 2 (Japanese Patent Application Laid-Open No. 2015-137576) discloses a vane rotary compressor as well as a concentric rotary compressor. The rotary compressor disclosed in Patent Document 2 discloses a horizontal rotary compressor in which a rotational shaft is parallel to the ground. This does not separately suggest an axial support of the rotational shaft.

However, in the related art rotary compressors as described above, axial displacement occurs due to magnetism in view of the characteristics of the drive motor, causing the roller to move up and down along the rotational shaft. Then, the roller rotates with both axial side surfaces in close contact with a main bearing or sub bearing facing them. This may cause friction loss between the roller and the main bearing or between the roller and the sub bearing, which may reduce compressor performance or reliability due to wear.

Furthermore, in the related art rotary compressors, as the roller moves in the axial direction, a large axial gap may be generated on an opposite side to where the roller moves in the axial direction. Then, leakage between compression chambers may occur through the axial gap, which may lower compression efficiency. Considering this, if a gap between the roller and the main bearing or sub bearing facing the roller is narrowed, it may be difficult to form an oil film, thereby causing friction loss.

DISCLOSURE OF INVENTION

Technical Problem

An aspect of the present disclosure is to provide a rotary compressor that is capable of suppressing friction loss or wear between a roller and a main bearing or/and a sub bearing facing the roller.

Another aspect of the present disclosure is to suppress friction loss or wear between a roller and a main bearing or/and a sub bearing facing the roller by limiting an axial movement of the roller.

Still another aspect of the present disclosure is to suppress friction loss by limiting an axial movement of a roller and reducing an axial friction area.

Another aspect of the present disclosure is to provide a rotary compressor that is capable of increasing oil film pressure on an axial bearing surface that supports axial displacement of a rotational shaft.

Another aspect of the present disclosure is to provide a rotary compressor having an oil film pressure generator disposed between a roller and a main bearing or/and a sub bearing facing the roller.

Another aspect of the present disclosure is to form an oil film pressure generator between a roller and a main bearing or/and a sub bearing facing the roller, and to ensure smooth oil supply to the oil film pressure generator.

Another aspect of the present disclosure is to provide a rotary compressor that is capable of suppressing tilting of a roller.

Another aspect of the present disclosure is to provide a rotary compressor that is capable of evenly maintaining axial support force for a roller.

Another aspect of the present disclosure is to provide a rotary compressor that is capable of suppressing a roller from being tilted by compensating for a pressure difference between back pressure pockets when back pressure pockets having different pressure are formed between the roller and a main bearing or/and sub bearing facing the roller.

Solution to Problem

In order to achieve these and other advantages and in accordance with the purpose of this specification, as embodied and broadly described herein, there is provided a rotary compressor including a casing, a cylinder, a roller, a vane, a main bearing, and a sub bearing. The casing may have a sealed inner space where oil is stored. The cylinder may be disposed in an inner space of the casing to define a compression space. The roller may be disposed on a rotational shaft to be rotatable in the inner space of the cylinder. The vane may be slidably inserted into a vane slot formed in the roller to rotate together with the roller. The main bearing and the sub bearing may be disposed on both sides of the cylinder in an axial direction to form the compression space together with the cylinder. At least one of the main bearing and the sub bearing may have a back pressure pocket formed at a preset depth in a sliding surface facing an axial side surface of the roller. At least one axial support part extending from an outer circumferential surface of the back pressure pocket may be formed at a preset depth in the sliding surface. Through this, oil film pressure supporting the roller in the axial direction can increase to stably support the roller including the rotational shaft in the axial direction, thereby effectively suppressing friction loss and wear between the roller and the main bearing facing the roller and between the roller and the sub bearing.

For example, a circumferential length of the axial support part may be shorter than a circumferential length of the back pressure pocket. Through this, an edge effect can occur in the axial support part in the circumferential direction, so that oil film pressure in the axial support part can increase.

As another example, an axial depth of the axial support part may be shallower than an axial depth of the back pressure pocket. Through this, an edge effect can occur in the axial support part in a circumferential direction, so that oil film pressure in the axial support part can increase.

As another example, the axial support part may be provided in plurality disposed along the circumferential direction. The plurality of axial support parts may be formed at equal gaps along the circumferential direction. Through this, oil film pressure can be evenly maintained in the axial support parts along the circumferential direction, thereby stably supporting the roller.

As another example, the axial support part may be provided in plurality disposed along a circumferential direction. At least some of the plurality of axial support parts may be formed at different gaps along the circumferential direction. Through this, even when a plurality of back pressure pockets with different pressures are disposed along the circumferential direction, oil film pressure in the axial support parts can be compensated for such that axial support force for the roller becomes uniform along the circumferential direction, thereby stably supporting the roller.

Specifically, the back pressure pocket may include a high-pressure side back pressure pocket and a low-pressure side back pressure pocket spaced apart from each other in the circumferential direction. A first gap between the plurality of axial support parts extending from the high-pressure side back pressure pocket may be narrower than a second gap between the plurality of axial support parts extending from the low-pressure side back pressure pocket. This can effectively suppress tilting of the roller due to a pressure difference between the back pressure pockets, thereby stably supporting the roller even if there are the plurality of back pressure pockets with the different pressure.

As another example, the axial support part may include a plurality of axial support parts that have a same cross-sectional area along a circumferential direction. This can facilitate machining of the axial support part while constantly maintaining oil film pressure in the axial support part.

As another example, the axial support part may include a plurality of axial support portions, and at least some of the axial support parts may have different cross-sectional areas in the circumferential direction. This can facilitate machining of the axial support part and stably support the roller by compensating for oil film pressure in the axial support part according to pressure of the back pressure pocket.

Specifically, the back pressure pocket may include a high-pressure side back pressure pocket and a low-pressure side back pressure pocket spaced apart from each other in the circumferential direction. A second cross-sectional area of the axial support part extending from the high-pressure side back pressure pocket may be smaller than a first cross-sectional area of the axial support part extending from the low-pressure side back pressure pocket. This can effectively suppress tilting of the roller due to a pressure difference between the back pressure pockets, thereby stably supporting the roller even if there are the plurality of back pressure pockets with the different pressure.

As another example, a back pressure chamber may further be defined in the roller and extend from the vane slot to overlap the back pressure pocket in the axial direction. A width of the back pressure chamber may be wider than a width of the vane slot. The back pressure pocket may be formed such that an outer circumferential surface thereof passes between the vane slot and the back pressure chamber. This can reduce a radial width of the back pressure pocket to facilitate machining of the back pressure pocket and secure an axial support area for a vane.

As another example, the axial support part may have both lateral surfaces in a circumferential direction, an outer surface connecting one end of each of the both lateral surfaces and an inner surface connecting another end of each of the both lateral surfaces. The lateral surfaces and the outer surface may be formed to be stepped, and the inner surface may be open to the outer circumferential surface of the back pressure pocket to communicate with the back pressure pocket. Both the lateral surfaces may be formed in a linear shape. This can increase an edge effect in the axial support part, thus to facilitate machining of the lateral surfaces of the axial support part while improving oil film pressure.

As another example, the axial support part may have both lateral surfaces in a circumferential direction, an outer surface connecting one end of each of the both lateral surfaces and an inner surface connecting another end of each of the both lateral surfaces. The lateral surfaces and the outer surface may be formed to be stepped, and the inner surface may be open to the outer circumferential surface of the back pressure pocket to communicate with the back pressure pocket. Both the lateral surfaces may be formed in a curved shape. This can increase oil flow speed in the axial support part, thus to reduce friction loss between an edge of the axial support part and the roller while improving oil film pressure.

Here, the axial support part may be formed to be inclined inward with respect to a rotating direction of the roller. Through this, oil in the axial support part can flow in a forward direction with respect to the rotating direction of the roller, which can increase oil flow speed, thereby increasing oil film pressure.

Also, the axial support part may be formed to be inclined outward with respect to a rotating direction of the roller. Through this, oil film pressure in the axial support part can be improved and also oil in the axial support part can move smoothly to an axial bearing surface between the roller and the bearing, thereby improving a lubrication effect on the axial bearing surface.

Additionally, the axial support part may extend in a radial direction with respect to a center of the roller. This can facilitate machining of the axial support part while improving oil film pressure of oil in the axial support part.

Advantageous Effects of Invention

A rotary compressor according to an embodiment of the present disclosure may be configured such that at least one axial support part extending from an outer circumferential surface of a back pressure pocket is formed at a preset depth in at least one of a main bearing and a sub bearing. Through this, oil film pressure supporting a roller in an axial direction can increase to stably support the roller including a rotational shaft in an axial direction, thereby effectively suppressing friction loss and wear between the roller and the main bearing facing the roller and between the roller and the sub bearing.

In the rotary compressor according to an embodiment of the present disclosure, a circumferential length of the axial support part may be shorter than a circumferential length of the back pressure pocket. Through this, an edge effect can occur in the axial support part in a circumferential direction, so that oil film pressure in the axial support part can increase.

In the rotary compressor according to an embodiment of the present disclosure, an axial depth of the axial support part may be shallower than an axial depth of the back pressure pocket. Through this, an edge effect can occur in the axial support part in the circumferential direction, so that oil film pressure in the axial support part can increase.

In the rotary compressor according to an embodiment of the present disclosure, axial support parts may be formed at equal gaps along a circumferential direction. Through this, oil film pressure can be constantly maintained in the axial support parts along the circumferential direction, thereby stably supporting the roller.

In the rotary compressor according to an embodiment of the present disclosure, at least some of axial support parts may be formed at non-equal gaps along a circumferential direction. Through this, even when a plurality of back pressure pockets with different pressures are disposed along the circumferential direction, oil film pressure in the axial support parts can be compensated for, such that axial support force for the roller becomes uniform along the circumferential direction, thereby stably supporting the roller.

In the rotary compressor according to an embodiment of the present disclosure, the axial support part may be formed with the same cross-sectional area along a circumferential direction. This can facilitate machining of the axial support parts while constantly maintaining oil film pressure in the axial support part.

In the rotary compressor according to an embodiment of the present disclosure, at least a portion of the axial support part may have a different cross-sectional area along a circumferential direction. This can facilitate machining of the axial support part and stably support the roller by compensating for oil film pressure in the axial support part according to pressure of the back pressure pocket.

In the rotary compressor according to an embodiment of the present disclosure, the back pressure pocket may be formed such that its outer circumferential surface passes between a vane slot and a back pressure chamber. This can reduce a radial width of the back pressure pocket to facilitate machining of the back pressure pocket and secure an axial support area for a vane.

In the rotary compressor according to an embodiment of the present disclosure, the axial support part may be formed to be inclined inward with respect to a rotating direction of the roller. Through this, oil in the axial support part can flow in a forward direction with respect to the rotating direction of the roller, which can increase oil flow speed, thereby increasing oil film pressure.

In the rotary compressor according to an embodiment of the present disclosure, the axial support part may be formed to be inclined outward with respect to a rotating direction of the roller. Through this, oil film pressure in the axial support part can be improved and also oil in the axial support part can move smoothly to an axial bearing surface between the roller and the bearing, thereby improving a lubrication effect on the axial bearing surface.

MODE FOR THE INVENTION

Description will now be given of a rotary compressor according to embodiments disclosed herein, with reference to the accompanying drawings. For reference, an axial support part according to an embodiment of the present disclosure may be equally applied to both an eccentric rotary compressor in which a roller is eccentrically disposed in a cylinder and a concentric rotary compressor in which a roller is concentrically disposed in a cylinder. In addition, an axial support part according to an embodiment of the present disclosure may be equally applied to a rotary compressor in which both axial side surfaces of a roller are in sliding contact with a main bearing and a sub bearing, for example, a vane rotary compressor in which a vane is slidably inserted into the roller. Hereinafter, a description will focus on an example in which an axial support part according to an embodiment is disposed in a vane rotary compressor, which is also a concentric rotary compressor and in which a vane is inserted into a roller.

Figure 1:
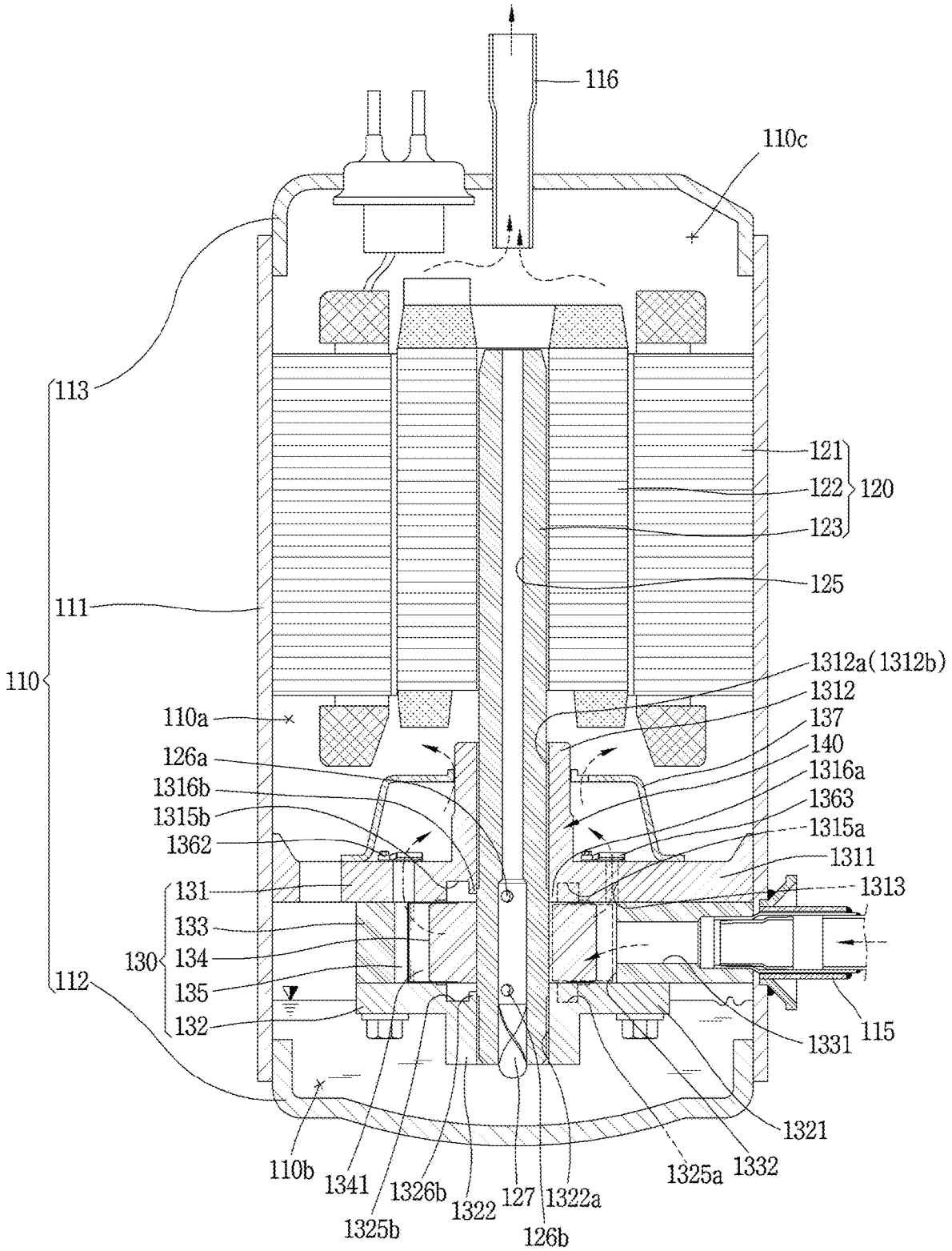
FIG. 1 is a cross-sectional view illustrating one embodiment of a vane rotary compressor according to the present disclosure.
Figure 2:
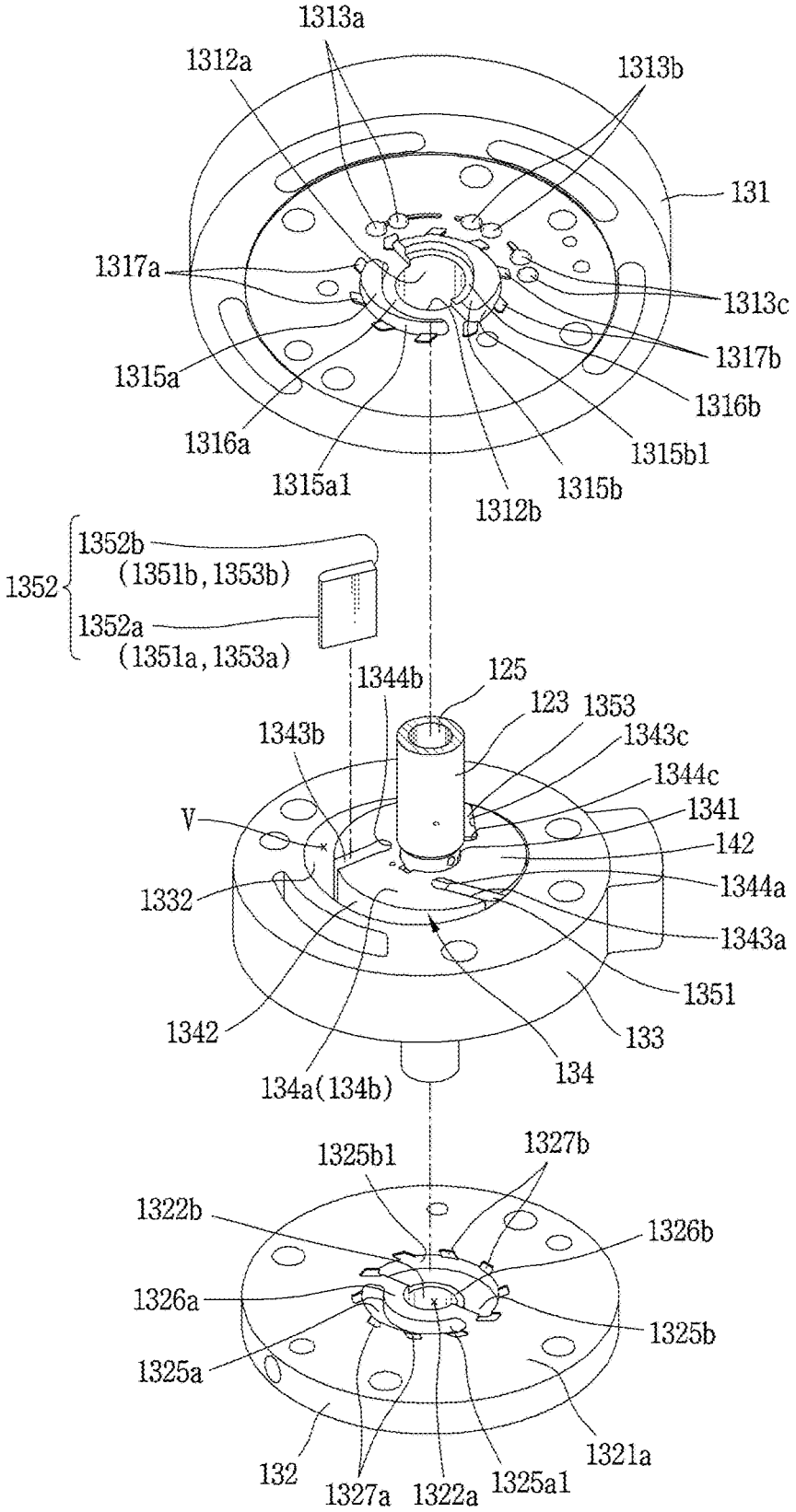
FIG. 2 is an exploded perspective view illustrating a compression part in FIG. 1.
Figure 3:
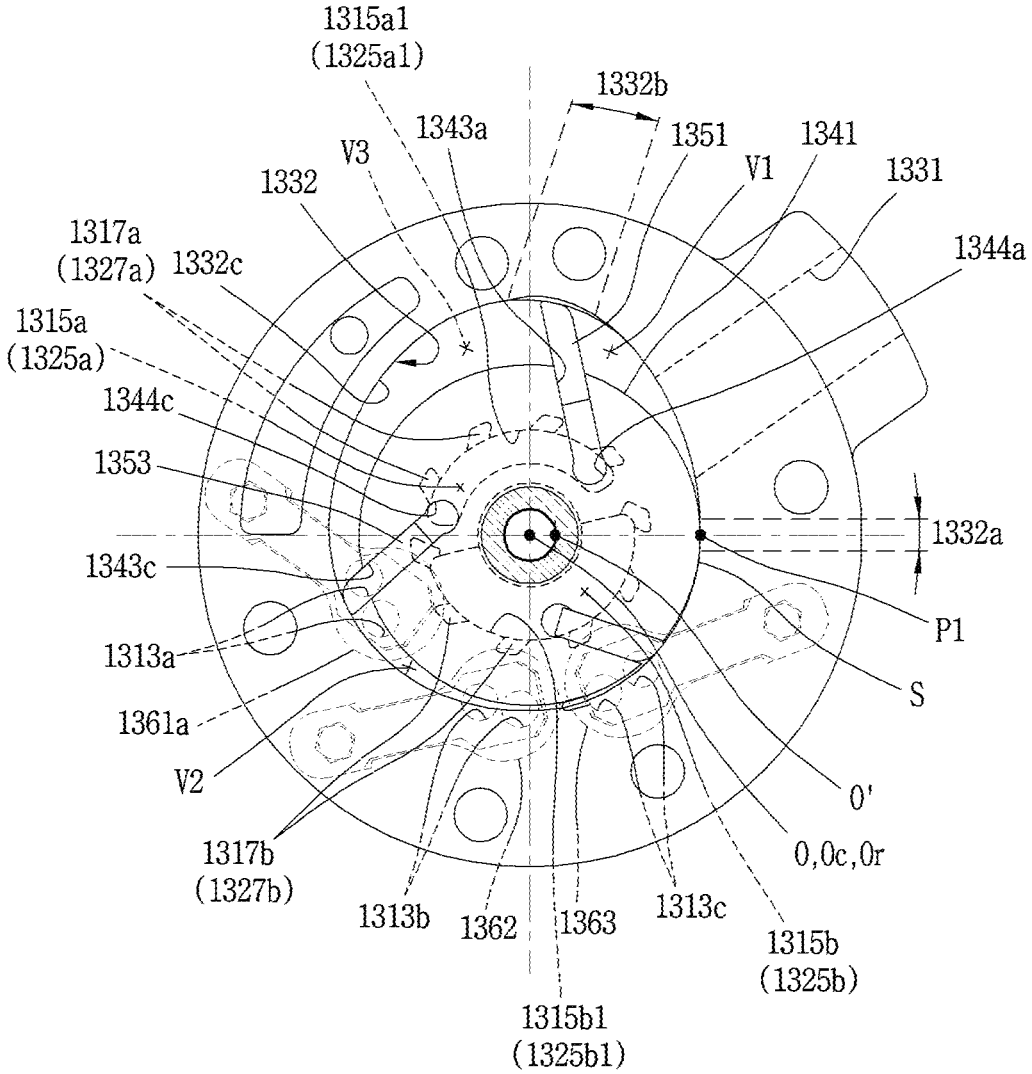
FIG. 3 is a planar view illustrating an assembled state of the compression part in FIG. 2.

FIG. 1 is a cross-sectional view illustrating one embodiment of a vane rotary compressor according to the present disclosure, FIG. 2 is an exploded perspective view illustrating a compression part in FIG. 1, and FIG. 3 is an assembled planar view of the compression part in FIG. 2.

Referring to FIG. 1, a vane rotary compressor according to an embodiment of the present disclosure includes a casing 110, a driving (or drive) motor 120, and a compression part 130. The drive motor 120 is installed in an upper inner space 110*a* of the casing 110, and the compression part 130 is installed in a lower inner space 110*a* of the casing 110. The drive motor 120 and the compression part 130 are connected through a rotational shaft 123.

The casing 110 that defines an outer appearance of the compressor may be classified as a vertical type and a horizontal type according to a compressor installation method. As for the vertical type casing, the drive motor 120 and the compression part 130 are disposed at upper and lower sides in an axial direction, respectively. As for the horizontal type casing, the drive motor 120 and the compression part 130 are disposed at left and right sides, respectively. The casing according to this embodiment may be illustrated as the vertical type.

The casing 110 includes an intermediate shell 111 having a cylindrical shape, a lower shell 112 covering a lower end of the intermediate shell 111, and an upper shell 113 covering an upper end of the intermediate shell 111.

The drive motor 120 and the compression part 130 may be inserted into the intermediate shell 111 to be fixed thereto, and a suction pipe 115 may penetrate through the intermediate shell 111 to be directly connected to the compression part 130. The lower shell 112 may be coupled to the lower end of the intermediate shell 111 in a sealing manner, and an oil storage space 110*b* in which oil to be supplied to the compression part 130 is stored may be formed below the compression part 130. The upper shell 113 may be coupled to the upper end of the intermediate shell 111 in a sealing manner, and an oil separation space 110*c* may be formed above the drive motor 120 to separate oil from refrigerant discharged from the compression part 130.

The drive motor 120 that constitutes a motor part supplies power to cause the compression part 130 to be driven. The drive motor 120 includes a stator 121, a rotor 122, and a rotational shaft 123.

The stator 121 may be fixedly inserted into the casing 110. The stator 121 may be fixed to an inner circumferential surface of the casing 110 in a shrink-fitting manner or the like. For example, the stator 121 may be press-fitted into an inner circumferential surface of the intermediate shell 111.

The rotor 122 may be rotatably inserted into the stator 121, and the rotational shaft 123 may be press-fitted into a center of the rotor 122. Accordingly, the rotational shaft 123 rotates concentrically together with the rotor 122.

An oil flow path 125 having a hollow hole shape is formed in a central portion of the rotational shaft 123, and oil passage holes 126*a* and 126*b* are formed through a middle portion of the oil flow path 125 toward an outer circumferential surface of the rotational shaft 123. The oil passage holes 126*a* and 126*b* include a first oil passage hole 126*a* belonging to a range of a main bush portion 1312 to be described later and a second oil passage hole 126*b* belonging to a range of a second bearing portion 1322. Each of the first oil passage hole 126*a* and the second oil passage hole 126*b* may be provided by one or in plurality. This embodiment shows an example in which a plurality of oil passage holes is formed.

An oil pickup 127 may be installed in a middle or lower end of the oil passage 125. A gear pump, a viscous pump, or a centrifugal pump may be used for the oil pickup 127. This embodiment illustrates a case in which the centrifugal pump is employed. Accordingly, when the rotational shaft 123 rotates, oil filled in the oil storage space 110*b* is pumped by the oil pickup 127 and is sucked along the oil flow path 125, so as to be introduced into a sub bearing surface 1322*b* of the sub bush portion 1322 through the second oil passage hole 126*b* and into a main bearing surface 1312*b* of the main bush portion 1312 through the first oil passage hole 126*a*.

Additionally, the rotational shaft 123 may be integrally formed with the roller 134 to be explained later or the roller 134 may be post-assembled by being press-fitted to the rotational shaft 123. In an embodiment of the present disclosure, a description will focus on an example in which the roller 134 is formed integrally with the rotational shaft 123, and the roller 134 will be described again later.

The compression part 130 includes a main bearing 131, a sub bearing 132, a cylinder 133, a roller 134, and a plurality of vanes 1351, 1352, and 1353. The main bearing 131 and the sub bearing 132 are respectively provided at upper and lower parts of the cylinder 133 to define a compression space V together with the cylinder 133, the roller 134 is rotatably installed in the compression space V, and the vanes 1351, 1352, and 1353 are slidably inserted into the roller 134 to divide the compression space V into a plurality of compression chambers.

Referring to FIGS. 1 to 3, the main bearing 131 may be fixedly installed in the intermediate shell 111 of the casing 110. For example, the main bearing 131 may be inserted into the intermediate shell 111 and welded thereto.

The main bearing 131 may be coupled to an upper end of the cylinder 133 in a close contact manner. Accordingly, the main bearing 131 defines an upper surface of the compression space V, and supports an upper surface of the roller 134 in the axial direction and at the same time supports an upper portion of the rotational shaft 123 in the radial direction.

The main bearing 131 may include a main plate portion 1311 and a main bush portion 1312. The main plate portion 1311 covers an upper part of the cylinder 133 to be coupled thereto, and the main bush portion 1312 axially extends from a center of the main plate portion 1311 toward the drive motor 120 so as to support the upper portion of the rotational shaft 123.

The main plate portion 1311 may have a disk shape, and the outer circumferential surface of the main plate portion 1311 may be fixed to the inner circumferential surface of the intermediate shell 111 in a close contact manner. One or more discharge ports 1313*a*, 1313*b*, and 1313*c* may be formed in the main plate portion 1311, and a plurality of discharge valves 1361, 1362, and 1363 configured to open and close the respective discharge ports 1313*a*, 1313*b*, and 1313*c* may be installed on an upper surface of the main plate portion 1311, and a discharge muffler 137 having a discharge space (no reference numeral) may be provided at an upper part of the main plate portion 1311 to accommodate the discharge ports 1313*a*, 1313*b*, and 1313*c*, and the discharge valves 1361, 1362, and 1363. The discharge ports will be described again later.

A first main back pressure pocket 1315*a* and a second main back pressure pocket 1315*b* may be formed in a lower surface, namely, a main sliding surface (hereinafter, also referred to as a first sliding surface) 1311*a* of the main plate portion 1311 facing the upper surface of the roller 134, of both axial side surfaces of the main plate portion 1311.

The first main back pressure pocket 1315*a* and the second main back pressure pocket 1315*b* each having an arcuate shape may be disposed at a predetermined interval in a circumferential direction. Each of the first main back pressure pocket 1315*a* and the second main back pressure pocket 1315*b* may have an inner circumferential surface formed in a circular shape, but may have an outer circumferential surface formed in an oval or elliptical shape in consideration of vane slots 1343*a*, 1343*b*, and 1343*c* to be described later.

However, the first main back pressure pocket 1315*a* and the second main back pressure pocket 1315*b* according to an embodiment of the present disclosure may have inner and outer circumferential surfaces each formed in a circular shape. The outer circumferential surface 1315*a*1 of the first main back pressure pocket 1315*a* and the outer circumferential surface 1315*b*1 of the second main back pressure pocket 1315*a* may be formed to pass between vane slots 1343*a*, 1343*b*, and 1343*c* and back pressure chambers 1344*a*, 1344*b*, and 1344*c*, respectively. Accordingly, radial widths of the first main back pressure pocket 1315*a* and the second main back pressure pocket 1315*b* can decrease. This can facilitate machining of the first main back pressure pocket 1315*a* and the second main back pressure pocket 1315*b*. In addition, axial support force can be secured near a contact point P1 for each vane 1351, 1352, 1353.

Furthermore, main axial support parts (portions) 1317, which will be described later, may extend from the outer circumferential surface 1315*a*1 of the first main back pressure pocket 1315*a* and the outer circumferential surface 1315*a*1 of the second main back pressure pocket 1315*b*, respectively. For example, main axial support parts (portions) 1317*a* and 1317*b* may extend from the outer circumferential surface 1315*a*1 of the first main back pressure pocket 1315*a* and the outer circumferential surface 1315*b*1 of the second main back pressure pocket 1315*b*, respectively.

For example, first main axial support parts (portions) 1317*a* may extend from the outer circumferential surface 1315*a*1 of the first main back pressure pocket 1315*a* and second main axial support parts (portions) 1317*b* may extend from the outer circumferential surface 1315*b*1 of the second main back pressure pocket 1315*b*. Accordingly, oil of the first main back pressure pocket 1315*a* can be smoothly introduced into the first main axial support parts 1317*a* and oil of the second main back pressure pocket 1315*b* can be smoothly introduced into the second main axial support part 1317*b*.

A circumferential length L21 of the first main axial support part 1317*a* may be shorter than a circumferential length L11 of the first main back pressure pocket 1315*a*, and a circumferential length L22 of the second main axial support part 1317*b* may be shorter than a circumferential length L12 of the second main back pressure pocket 1315*b*. Accordingly, internal pressure, that is, oil film pressure can increase in each of the main axial support parts 1317*a* and 1317*b*, thereby supporting an upper surface 134*a* of the roller 134 in the axial direction. This will be described again in conjunction with the axial support part 1317 later.

In addition, the main axial support parts 1317*a* and 1317*b* may be formed on the outer circumferential surface 1315*a*1 of the first main back pressure pocket 1315*a* and the outer circumferential surface 1315*b*1 of the second main back pressure pocket 1315*b*, respectively, and outer surfaces 1317*a*3 and 1317*b*3 of the respective axial support parts 1317*a* and 1317*b* may be located within an outer diameter range of the roller 134. Accordingly, the first main back pressure pocket 1315*a* and the second main back pressure pocket 1315*b* that include the axial support parts 1317*a* and 1317*b*, respectively, may be separated from the compression space V. However, the first main back pressure pocket 1315*a* and the second main back pressure pocket 1315*b* may minutely communicate with each other through a gap between one axial side surface 134*a* of the roller 134 and the sliding surface 1311*a* facing the one axial side surface, unless a separate sealing member is disposed between the lower surface of the main plate portion 1311 and the one axial side surface 134*a* of the roller 134 facing the lower surface. This will be described again later together with the axial support part.

The first main back pressure pocket 1315*a* forms pressure lower than pressure formed in the second main back pressure pocket 1315*b*, for example, forms intermediate pressure between suction pressure and discharge pressure. Oil (refrigerant oil) may pass through a fine passage between a first main bearing protrusion 1316*a* to be described later and the upper surface 134*a* of the roller 134 so as to be introduced into the first main back pressure pocket 1315*a*. The first main back pressure pocket 1315*a* may be formed in the range of a compression chamber forming intermediate pressure in the compression space V. This may allow the first main back pressure pocket 1315*a* to maintain the intermediate pressure.

The second main back pressure pocket 1315*b* may form pressure higher than that in the first main back pressure pocket 1315*a*, for example, discharge pressure or intermediate pressure between suction pressure close to the discharge pressure and the discharge pressure. Oil flowing into the main bearing hole 1312*a* of the main bearing 1312 through the first oil passage hole 126*a* may be introduced into the second main back pressure pocket 1315*b*. The second main back pressure pocket 1315*b* may be formed in the range of a compression chamber forming a discharge pressure in the compression space V. This may allow the second main back pressure pocket 1315*b* to maintain the discharge pressure.

In addition, a first main bearing protrusion 1316*a* and a second main bearing protrusion 1316*b* may be formed on inner circumferential sides of the first main back pressure pocket 1315*a* and the second main back pressure pocket 1315*b*, respectively, in a manner of extending from the main bearing surface 1312*b* of the main bush potion 1312. Accordingly, the first main back pressure pocket 1315*a* and the second main back pressure pocket 1315*b* can be sealed from outside and simultaneously the rotational shaft 123 can be stably supported.

The first main bearing protrusion 1316*a* and the second main bearing protrusion 1316*b* may have the same height. Here, an oil communication groove (not illustrated) or an oil communication hole (not illustrated) may be formed in an end surface on an inner circumferential side of the second main bearing protrusion 1316*b*. Alternatively, the height on the inner circumferential side of the second main bearing protrusion 1316*b* may be lower than the height on an inner circumferential side of the first main bearing protrusion 1316*a*. Accordingly, high-pressure oil (refrigerant oil) flowing into the main bearing surface 1312*b* flows into the second main back pressure pocket 1315*b*, and the second main back pressure pocket 1315*b* forms higher pressure (discharge pressure) than the first main back pressure pocket 1315*a*.

Referring to FIGS. 1 to 3, the sub bearing 132 may be coupled to a lower end of the cylinder 133 in a close contact manner. Accordingly, the sub bearing 132 defines a lower surface of the compression space V, and supports a lower surface of the roller 134 in the axial direction while supporting a lower-half portion of the rotational shaft 123 in the radial direction.

The sub bearing 132 may include a sub plate potion 1321 and the sub bush portion 1322. The sub plate portion 1321 covers a lower part of the cylinder 133 to be coupled to thereto, and the sub bush portion 1322 axially extends from a center of the sub plate portion 1321 toward the lower shell 112 so as to support the lower portion of the rotational shaft 123.

The sub plate portion 1321 may have a disk shape like the main plate portion 1311, and an outer circumferential surface of the sub plate portion 1321 may be spaced apart from the inner circumferential surface of the intermediate shell 111.

A first sub back pressure pocket 1325*a* and a second sub back pressure pocket 1325*b* may be formed in an upper surface, namely, a sub sliding surface (hereinafter, also referred to as a second sliding surface) 1321*a* of the sub plate portion 1321, which faces another side surface (e.g., lower surface) 134*b* of the roller 134, of both axial side surfaces of the sub plate portion 1321.

The first sub back pressure pocket 1325*a* and the second sub back pressure pocket 1325*b* may be symmetric to the first main back pressure pocket 1315*a* and the second main back pressure pocket 1315*b*, respectively, with respect to the roller 134.

For example, the first sub back pressure pocket 1325*a* and the first main back pressure pocket 1315*a* may be symmetric to each other, and the second sub back pressure pocket 1325*b* and the second main back pressure pocket 1315*b* may be symmetric to each other. Accordingly, a first sub bearing protrusion 1326*a* may be formed on an inner circumferential side of the first sub back pressure pocket 1325*a*, and a second sub bearing protrusion 1326*b* may be formed on an inner circumferential side of the second sub back pressure pocket 1325*b*.

Descriptions of the first sub back pressure pocket 1325*a* and the second sub back pressure pocket 1325*b*, and the first sub bearing protrusion 1326*a* and the second sub bearing protrusion 1326*b* are replaced by the descriptions of the first main back pressure pocket 1315*b* and the second main back pressure pocket 1316*b*, and the first main bearing protrusion 1316*a* and the second main bearing protrusion 1316*b*.

However, in some cases, the first sub back pressure pocket 1325*a* and the second sub back pressure pocket 1325*b* may be asymmetric to the first main back pressure pocket 1315*a* and the second main back pressure pocket 1315*b*, respectively, with respect to the roller 134. For example, the first sub back pressure pocket 1325*a* and the second sub back pressure pocket 1325*b* may be formed to be deeper than the first main back pressure pocket 1315*a* and the second main back pressure pocket 1315*b*, respectively.

In addition, sub axial support parts 1327 may extend from an outer circumferential surface 1325*a*1 of the first sub back pressure pocket 1325*a* and an outer circumferential surface 1325*b*1 of the second sub back pressure pocket 1325*b*. In other words, first sub axial support parts 1327*a* may extend from the outer circumferential surface 1325*a*1 of the first sub back pressure pocket 1325*a* and second sub axial support parts 1327*b* may extend from the outer circumferential surface 1325*b*1 of the second sub back pressure pocket 1325*b*.

A circumferential length L21 of the first sub axial support part 1327*a* may be shorter than a circumferential length L11 of the first sub back pressure pocket 1325*a*, and a circumferential length L22 of the second sub axial support part 1327*b* may be shorter than a circumferential length L12 of the second sub back pressure pocket 1325*b*. Accordingly, internal pressure, that is, oil film pressure can increase in each sub axial support part 1327, thereby supporting the lower surface 134*b* of the roller 134 in the axial direction. This will be described again later together with the axial support part.

In addition, an oil supply hole (not illustrated) to be explained later may be formed between the first sub back pressure pocket 1325*a* and the second sub back pressure pocket 1325*b*, more precisely, between the first sub bearing protrusion 1326*a* and the second sub bearing protrusion 1326*b* or in a portion where the first sub bearing protrusion 1326*a* and the second sub bearing protrusion 1326*b* are connected to each other.

For example, a first end defining an entrance of the oil supply hole (not illustrated) may be submerged in the oil storage space 110*b*, and a second end defining an exit of the oil supply hole may be located on a rotation path of the back pressure chamber 1344*a*, 1344*b*, and 1344*c* to be explained later in the upper surface of the sub plate portion 1321 facing the lower surface of the roller 134 to be described later. Accordingly, when the roller 134 rotates, the back pressure chamber 1344*a*, 1344*b*, and 1344*c* may periodically communicate with the oil supply hole (not illustrated), such that oil of high pressure stored in the oil storage space 110*b* can be periodically supplied to the back pressure chamber 1344*a*, 1344*b*, and 1344*c* through the oil supply hole (not illustrated). This can allow the vane 1351, 1352, 1353 to be stably supported toward the inner circumferential surface 1332 of the cylinder 133.

Although not illustrated in the drawings, the back pressure pockets 1315*a*, 1315*b*, 1325*a*, 1325*b* may be provided only at any one of the main bearing 131 and the sub bearing 132.

Meanwhile, the discharge port 1313 may be formed in the main bearing 131 as described above. However, the discharge port may be formed in the sub bearing 132, formed in each of the main bearing 131 and the sub bearing 132, or formed by penetrating between inner and outer circumferential surfaces of the cylinder 133. This embodiment describes an example in which the discharge ports 1313 are formed in the main bearing 131.

The discharge port 1313 may be provided by one. However, in this embodiment, the plurality of discharge ports 1313*a*, 1313*b*, and 1313*c* may be formed at predetermined intervals along a compression proceeding direction (or a rotational direction of the roller).

In general, in the vane rotary compressor, as the roller 134 is disposed eccentrically with respect to the compression space V, a contact point P1 at which the roller 134 and the cylinder 133 almost come in contact with each other is generated between the outer circumferential surface 1342 of the roller 134 and the inner circumferential surface 1332 of the cylinder 133. The discharge port 1313 is formed adjacent to the contact point P1. Accordingly, as the compression space V approaches the contact point P, a gap between the inner circumferential surface 1332 of the cylinder 133 and the outer circumferential surface 1342 of the roller 134 is greatly decreased, which makes it difficult to secure an area of the discharge port.

Thus, as in the embodiment of the present disclosure, the discharge port 1313 may be divided into a plurality of discharge ports 1313*a*, 1313*b*, and 1313*c* to be disposed along a direction of rotation (or direction of compression) of the roller 134. In addition, the plurality of discharge ports 1313*a*, 1313*b*, and 1313*c* may be formed individually, but may be formed as pairs, as illustrated in an embodiment of the present disclosure.

For example, starting from a discharge port which is the most adjacent to the proximal portion 1332*a*, those discharge ports 1313 may be aligned sequentially in the order of the first discharge port 1313*a*, the second discharge port 1313*b*, and the third discharge port 1313*c*. A gap between the first discharge port 1313*a* and the second discharge port 1313*b* and/or a gap between the second discharge port 1313*b* and the third discharge port 1313*c* may be approximately similar to a gap between a preceding vane and a succeeding vane, namely, a circumferential length of each compression chamber.

For example, a first gap between the first discharge port 1313*a* and the second discharge port 1313*b* may be substantially the same as a second gap between the second discharge port 1313*b* and the third discharge port 1313*c*. The first gap and the second gap may be substantially the same as the circumferential lengths of the first compression chamber V1, the second compression chamber V2, and the third compression chamber V3. Accordingly, the first discharge port 1313*a* can communicate with the first compression chamber V1, the second discharge port 1313*a* can communicate with the second compression chamber V2, and the third discharge port 1313*c* may communicate with the third communication chamber V3, instead of the plurality of discharge ports 1313 communicating with one compression chamber or the plurality of compression chambers communicating with one discharge port 1313.

However, when vane slots 1343*a*, 1343*b*, and 1343*c* are formed at unequal intervals, a circumferential length of each compression chamber V1, V2, V3 may be different, and the plurality of discharge ports may communicate with one compression chamber or one discharge port may communicate with the plurality of compression chambers.

In addition, the plurality of discharge ports 1313*a*, 1313*b*, and 1313*c* may be opened and closed by the discharge valves 1361, 1362, and 1363, respectively. Each of the discharge valves 1361, 1362, and 1363 may be implemented as a cantilever type reed valve having one end fixed and another end free. These discharge valves 1361, 1362, and 1362 are widely known in the typical rotary compressor, so a detailed description thereof will be omitted.

Referring to FIGS. 1 to 3, the cylinder 133 according to an embodiment of the present disclosure may be in close contact with the lower surface of the main bearing 131 and coupled to the main bearing 131 by a bolt together with the sub bearing 132. Accordingly, the cylinder 133 may be fixedly coupled to the casing 110 by the main bearing 131.

The cylinder 133 may be formed in an annular shape having a hollow space in its center to define the compression space V. The hollow space may be sealed by the main bearing 131 and the sub bearing 132 to define the compression space V, and the roller 134 to be described later may be rotatably coupled to the compression space V.

The cylinder 133 may be provided with a suction port 1331 penetrating from an outer circumferential surface to an inner circumferential surface thereof. However, the suction port may alternatively be formed through the main bearing 131 or the sub bearing 132.

The suction port 1331 may be formed at one side of the contact point P1 to be described later in the circumferential direction. The discharge port 1313 described above may be formed through the main bearing 131 at another side of the contact point P1 in the circumferential direction that is opposite to the suction port 1331.

The inner circumferential surface 1332 of the cylinder 133 may be formed in an elliptical shape. The inner circumferential surface 1332 of the cylinder 133 according to this embodiment may be formed in an asymmetric elliptical shape in which a plurality of ellipses, for example, four ellipses having different major and minor ratios are combined to have two origins.

In detail, the inner circumferential surface 1332 of the cylinder 133 according to the embodiment may be defined to have a first origin O that is a rotation center of the roller 134 (an axial center or a diameter center of the cylinder) to be explained later and a second origin O' biased from the first origin O toward the contact point P1.

In addition, the inner circumferential surface 1332 of the cylinder 133 may include a proximal portion 1332*a*, a remote portion 1332*b*, and a curved portion 1332*c*. The proximal portion 1332*a* is a portion closest to the outer circumferential surface 1342 (or the center of rotation) of the roller 134, the remote portion 1332*b* is a portion farthest away from the outer circumferential surface 1342 of the roller 134, and the curved portion 1332*c* is a portion connecting the proximal portion 1332*a* and the remote portion 1332*b*.

Referring to FIGS. 1 to 3, the roller 134 may be rotatably disposed in the compression space V of the cylinder 133, and the plurality of vanes 1351, 1352, 1353 to be explained later may be inserted in the roller 134 at preset gaps along the circumferential direction. Accordingly, the compression space V may be partitioned into as many compression chambers as the number of the plurality of vanes 1351, 1352, and 1353. The embodiment of the present disclosure illustrates an example in which the plurality of vanes 1351, 1352, and 1353 are three and thus the compression space V is partitioned into three compression chambers V1, V2, and V3.

The outer circumferential surface 1342 of the roller 134 according to the embodiment of the present disclosure may be formed in a circular shape, and the rotational shaft 123 may extend as a single body from or may be post-assembled and coupled to a rotation center Or of the roller 134. Accordingly, the rotation center Or of the roller 134 is coaxially located with an axial center (no reference numeral) of the rotational shaft 123, and the roller 134 rotates concentrically with the rotational shaft 123.

However, as described above, as the inner circumferential surface 1332 of the cylinder 133 is formed in the asymmetric elliptical shape biased in a specific direction, the rotation center Or of the roller 134 may be eccentrically disposed with respect to an outer diameter center Oc of the cylinder 133. Accordingly, one side of the outer circumferential surface 1342 of the roller 134 may be substantially brought into contact with the inner circumferential surface 1332 of the cylinder 133, precisely, the proximal portion 1332*a*, thereby defining the contact point P.

The contact point P1 may be formed in the proximal portion 1332*a* as described above. Accordingly, an imaginary line passing through the contact point P1 may correspond to a minor axis of an elliptical curve defining the inner circumferential surface 1332 of the cylinder 133.

In addition, the plurality of vane slots 1343*a*, 1343*b*, and 1343*c* may be formed at proper positions in the outer circumferential surface 1342 of the roller 134 to be spaced apart from each other in the circumferential direction. The vanes 1351, 1352, and 1353 to be explained later may be slidably inserted into the vane slots 1343*a*, 1343*b*, and 1343*c*, respectively.

The vane slots 1343*a*, 1343*b*, and 1343*c* may be defined as a first vane slot 1343*a*, a second vane slot 1343*b*, and a third vane slot 1343*c* along a compression-proceeding direction (a rotational direction of the roller). The first vane slot 1343*a*, the second vane slot 1343*b*, and the third vane slot 1343*c* may be formed in the same manner at equal or unequal intervals along the circumferential direction.

For example, each of the plurality of vane slots 1343*a*, 1343*b*, and 1343*c* may be inclined by preset angles with respect to the radial direction, so as to secure a sufficient length of each of the vanes 1351, 1352, and 1353. Accordingly, when the inner circumferential surface 1332 of the cylinder 133 is formed in the asymmetric elliptical shape, the separation of the vanes 1351, 1352, and 1353 from the vane slots 1343*a*, 1343*b*, and 1343*c* can be suppressed even if a distance from the outer circumferential surface 1342 of the roller 134 to the inner circumferential surface 1332 of the cylinder 133 increases. This may result in enhancing the freedom of design for the inner circumferential surface 1332 of the cylinder 133.

A direction in which the vane slots 1343*a*, 1343*b*, and 1343*c* are inclined may be a reverse direction to the rotational direction of the roller 134. That is, the front surfaces of the vanes 1351, 1352, and 1353 in contact with the inner circumferential surface 1332 of the cylinder 133 may be toward the rotational direction of the roller 134. This may be preferable in that a compression start angle can be formed ahead in the rotational direction of the roller 134 so that compression can start quickly.

The back pressure chambers 1344*a*, 1344*b*, and 1344*c* may be formed to communicate with the inner ends of the vane slots 1343*a*, 1343*b*, and 1343*c*, respectively. The back pressure chambers 1344*a*, 1344*b*, and 1344*c* may be spaces in which oil (or refrigerant) of discharge pressure or intermediate pressure is filled to flow toward the rear sides of the vanes 1351, 1352, and 1353, that is, the vane rear end portions 1351*c*, 1352*c*, and 1353*c*. The vanes 1351, 1352, and 1353 may be pressed toward the inner circumferential surface of the cylinder 133 by the pressure of the oil (or refrigerant) filled in the back pressure chambers 1344*a*, 1344*b*, and 1344*c*. Hereinafter, a direction toward the cylinder based on a motion direction of the vane may be defined as the front, and an opposite side to the direction may be defined as the rear.

The back pressure chamber 1344*a*, 1344*b*, and 1344*c* may be hermetically sealed by the main bearing 131 and the sub bearing 132. The back pressure chambers 1344*a*, 1344*b*, and 1344*c* may independently communicate with each of the back pressure pockets [1315*a*, and 1315*b*], [1325*a*, and 1325*b*], and may also communicate with each other through the back pressure pockets [1315*a*, and 1315*b*], and [1325*a*, and 1325*b*]

Referring to FIGS. 1 to 3, a plurality of vanes 1351, 1352, and 1353 according to this embodiment may be slidably inserted into the respective vane slots 1343*a*, 1343*b*, and 1343*c*. Accordingly, the plurality of vanes 1351, 1352, and 1353 may have substantially the same shape as the respective vane slots 1343*a*, 1343*b*, and 1343*c*.

For example, the plurality of vanes 1351, 1352, and 1353 are defined as a first vane 1351, a second vane 1352, and a third vane 1353 along the rotational direction of the roller 134. The first vane 1351 may be inserted into the first vane slot 1343*a*, the second vane 1352 may be inserted into the second vane slot 1343*b*, and the third vane 1353 may be inserted into the third vane slot 1343*c*, respectively.

The plurality of vanes 1351, 1352, and 1353 may have substantially the same shape.

Specifically, each of the plurality of vanes 1351, 1352, and 1353 may be formed substantially in a rectangular parallelepiped shape. The front surface 1351*a*, 1352*a*, 1353*a* in contact with the inner circumferential surface 1332 of the cylinder 133 may be formed as a curved surface and the rear surface 1351*b*, 1352*b*, 1353*b* facing the back pressure chamber 1344*a*, 1344*b*, and 1344*c* may be formed as a linear surface.

In the vane rotary compressor having the hybrid cylinder, when power is applied to the drive motor 120, the rotor 122 of the drive motor 120 and the rotational shaft 123 coupled to the rotor 122 rotate together, causing the roller 134 coupled to the rotational shaft 123 or integrally formed therewith to rotate together with the rotational shaft 123.

Then, the plurality of vanes 1351, 1352, and 1353 may be drawn out of the vane slots 1343*a*, 1343*b*, and 1343*c* by centrifugal force generated by the rotation of the roller 134 and back pressure of the back pressure chambers 1344*a*, 1344*b*, and 1344*c*, which support the rear surfaces 1351*b*, 1353*b*, 1353*b* of the vanes 1351, 1352, and 1353, thereby being brought into contact with the inner circumferential surface 1332 of the cylinder 133.

Then, the compression space V of the cylinder 133 may be partitioned by the plurality of vanes 1351, 1352, and 1353 into as many compression chambers (including suction chamber or discharge chamber) V1, V2, and V3 as the number of the vanes 1351, 1352, and 1353. The compression chambers V1, V2, and V3 may be changed in volume by the shape of the inner circumferential surface 1332 of the cylinder 133 and eccentricity of the roller 134 while moving in response to the rotation of the roller 134. Accordingly, refrigerant suctioned into the respective compression chambers V1, V2, and V3 can be compressed while moving along the roller 134 and the vanes 1351, 1352, and 1353, and discharged into the inner space of the casing 110. Such series of processes may be repeatedly carried out.

Meanwhile, as described above, the rotary compressor according to an embodiment of the present disclosure performs a kind of 'centering operation' that the rotational shaft moves in the vertical axial direction together with the rotor according to magnetism of the drive motor during operation. At this time, both axial side surfaces of the roller that is coupled to or integrally formed with the rotational shaft may define axial bearing surfaces with the main plate portion of the main bearing and the sub plate portion of the sub bearing facing the both side surfaces, thereby limiting the axial movement of the rotational shaft.

In other words, as the first axial bearing surface and the second axial bearing surface are formed between the both axial side surfaces of the roller and the lower surface (first sliding surface) of the main bearing and the upper surface (second sliding surface) of the sub bearing that face the both side surfaces of the roller, respectively, friction loss and wear may occur. In particular, as cross-sectional areas of the first axial bearing surface and the second axial bearing surface are formed to be wide, friction loss and wear may increase, which may lower motor efficiency and compression efficiency, thereby reducing overall compressor performance.

In addition, axial gaps between both axial side surfaces of the roller and the lower surface (the first sliding surface) of the main bearing and the upper surface (the second sliding surface) of the sub bearing facing the both axial side surfaces must be set in consideration of lubrication and sealing properties. For example, if the axial gaps are narrow, oil film formation may not be smoothly carried out, which is disadvantageous in terms of lubrication. Conversely, if the axial gaps are wide, it may be disadvantageous in terms of sealing each back pressure pocket.

Accordingly, in an embodiment of the present disclosure, the axial support parts that limit the axial movement of the rotational shaft while axially supporting the rotational shaft including the roller may be disposed on the main bearing and/or the sub bearing. Accordingly, the roller may be slightly lifted between the main bearing and the sub bearing without being in contact with the main bearing and the sub bearing. Through this, friction loss and wear that occurs between the roller and the main bearing or between the roller and the sub bearing can be reduced, thereby improving overall compressor performance. In addition, lubrication and sealing characteristics between the roller and the main bearing or between the roller and the sub bearing can be improved, thereby further enhancing compressor performance and compression efficiency.

The axial support parts according to an embodiment of the present disclosure may be formed on both the first axial bearing surface between the main bearing and the roller and the second axial bearing surface between the sub bearing and the roller, or may be formed on any one axial bearing surface. Hereinafter, an example in which the axial support parts are formed on both the first axial bearing surface and the second axial bearing surface will be mainly described. In addition, a description will be given by defining an axial support part formed on the first axial bearing surface as a main axial support part, and an axial support part formed on the second axial bearing surface as a sub axial support part. In addition, since the main axial support part and the sub axial support part are symmetrical with respect to the roller, the following description will focus on the main axial support part, and a description for the sub axial support part will be replaced with the description of the main axial support part.

Figure 4:
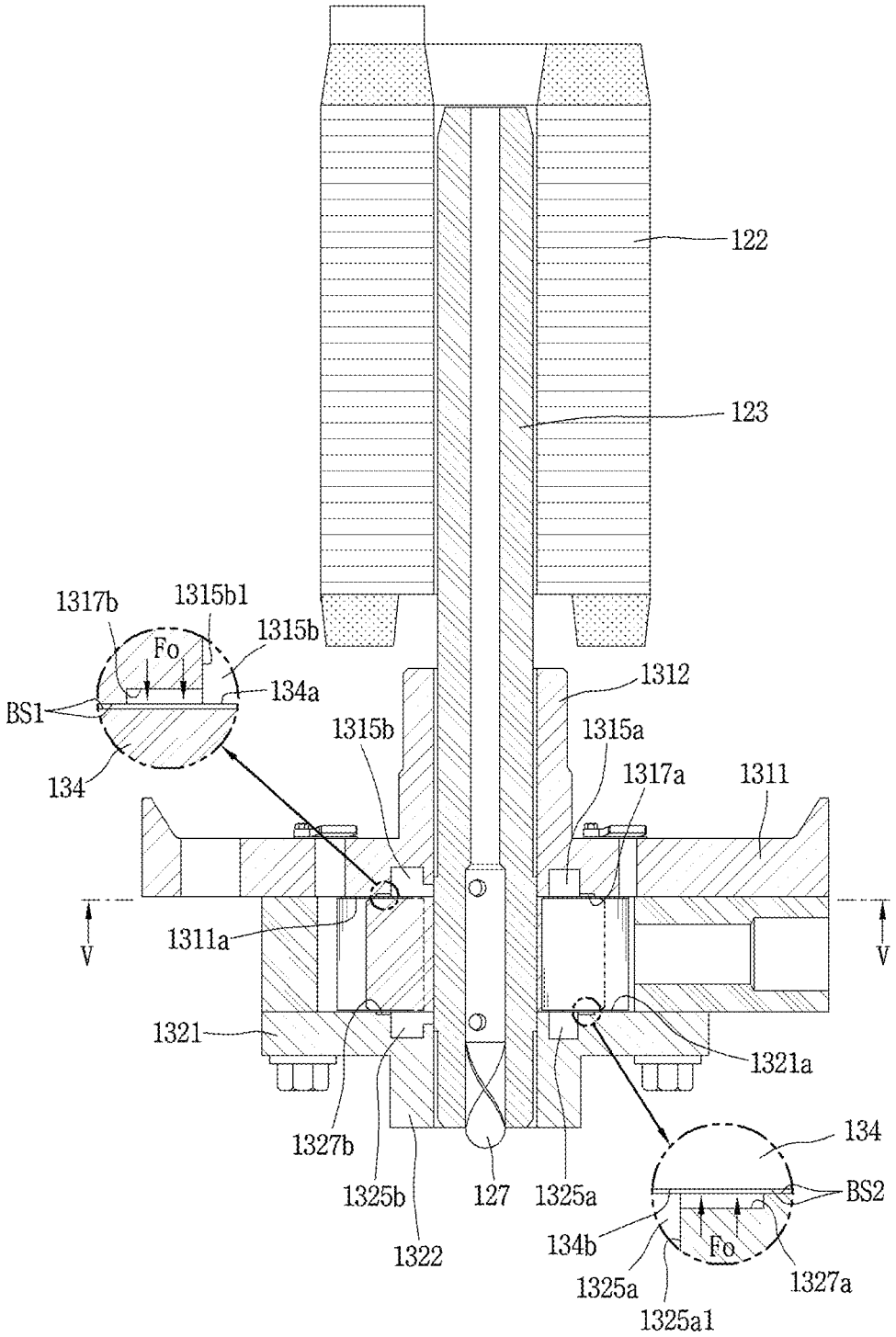
FIG. 4 is a cross-sectional view illustrating a portion of a motor part and the compression part in FIG. 1.
Figure 5:
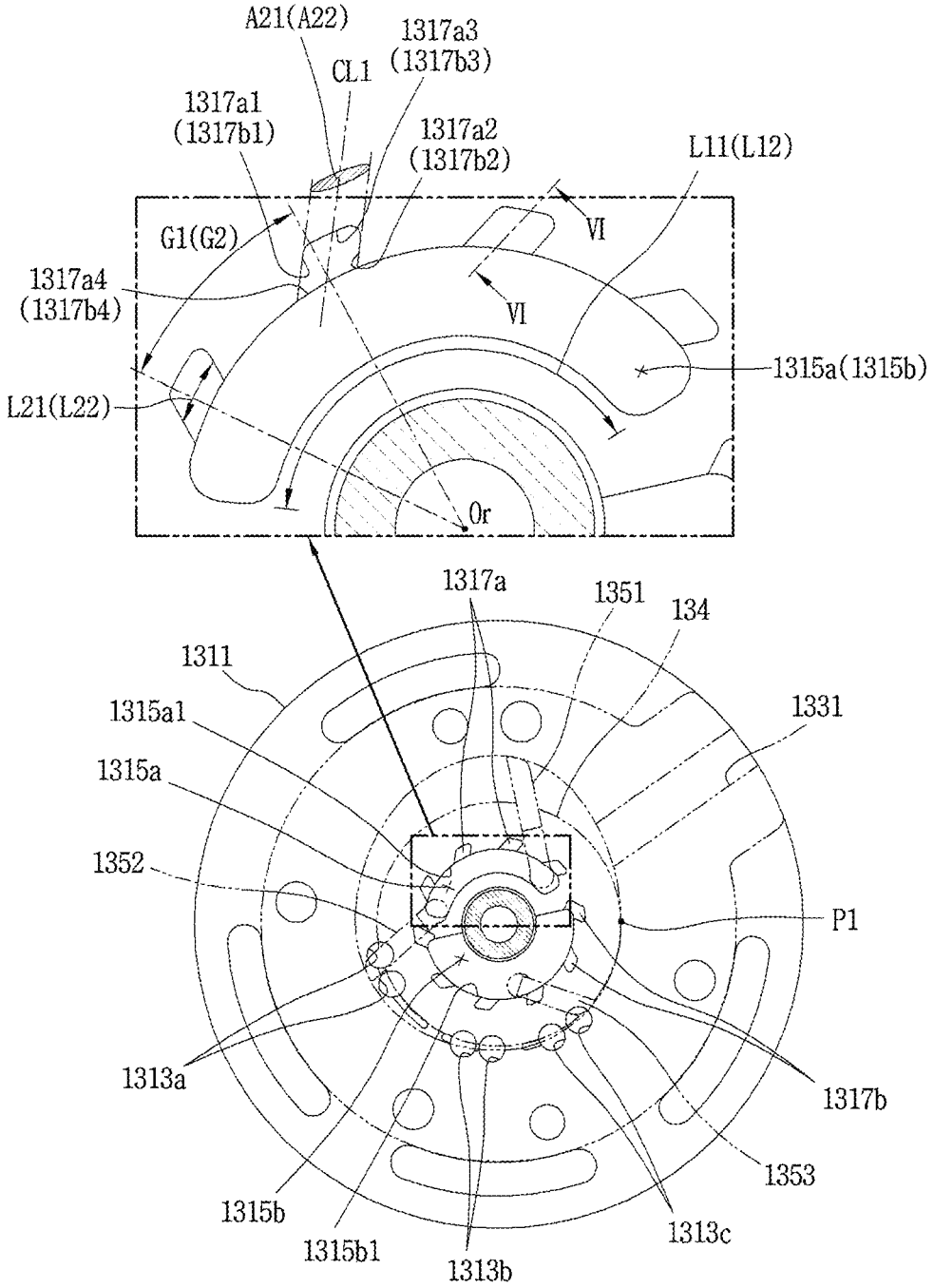
FIG. 5 is a cross-sectional view, taken along line "V-V" of FIG. 4.
Figure 6:
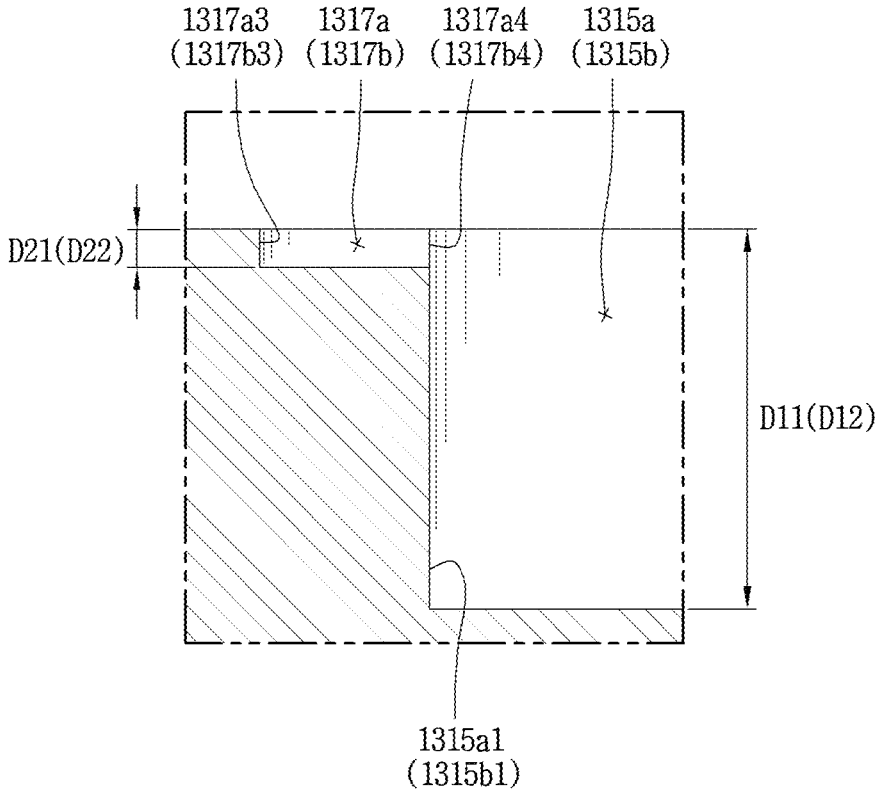
FIG. 6 is a cross-sectional view, taken along line "VI-VI" of FIG. 5.
Figure 7:
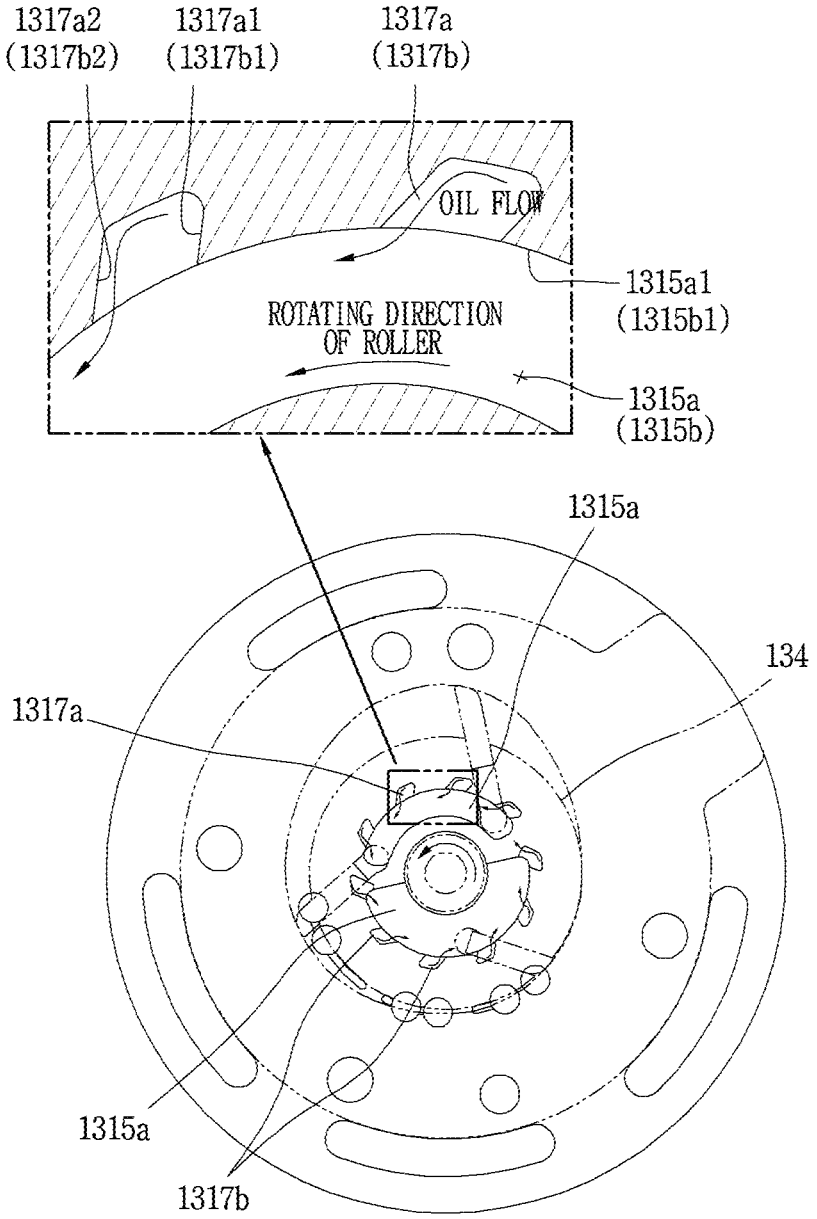
FIG. 7 is a planar view illustrating an oil flow in an axial support part in accordance with an embodiment.

FIG. 4 is a cross-sectional view illustrating a portion of a motor part and a compression part in FIG. 1, FIG. 5 is a cross-sectional view taken along the line "IV-IV" of FIG. 4, FIG. 6 is a cross-sectional view taken along the line "V-V" of FIG. 5, and FIG. 7 is a planar view illustrating an oil flow in the axial support part in accordance with an embodiment.

Referring to FIGS. 4 to 7, according to an embodiment of the present disclosure, the main axial support parts 1317 are formed between the main bearing 131 and the roller 134 facing the main bearing, precisely, on the first sliding surface 1311*a* of the main bearing 131, and the sub axial support parts 1327 are formed between the sub bearing 132 and the roller 134 facing the sub bearing, precisely, on the second sliding surface 1321*a* of the sub bearing 132.

The main axial support parts 1317 and the sub axial support parts 1327 may be formed to be symmetrical to each other on the same axis with respect to the roller 134. However, in some cases, considering the weight of the rotational shaft including the rotor and the roller 134, the sub axial support part 1327 may be formed to achieve greater oil film pressure than the main axial support part 1317. Hereinafter, a description will focus on an example in which the main axial support parts 1317 and the sub axial support parts 1327 are symmetrical with respect to the roller 134. Here, the main axial support part 1317 will be described as a representative example, and the sub axial support part 1327 will be understood by the description of the main axial support part 1317.

The main axial support part 1317 may be formed in a shape of a groove that is recessed by a preset depth into the first sliding surface 1311*a*. For example, the first main back pressure pocket 1315*a* and the second main back pressure pocket 1315*b* described above are formed in the first sliding surface 1311*a*. The first main axial support part 1317*a* may extend from the outer circumferential surface 1315*a*1 of the first main back pressure pocket 1315*a*, and the second main axial support part 1317*b* may extend from the outer circumferential surface 1315*b*1 of the second main back pressure pocket 1315*b*.

A circumferential length L21 of the first main axial support part 1317*a* may be shorter than a circumferential length L11 of the first main back pressure pocket 1315*a*, and a circumferential length L22 of the second main axial support part 1317*b* may be shorter than a circumferential length L12 of the second main back pressure pocket 1315*b*. Accordingly, oil in the first main axial support part 1317*a* and oil in the second main axial support part 1317*b* concentrate on circumferential lateral (or side) surfaces [1317*a*1, 1317*a*2] and [1317*b*1, 1317*b*2] of the main axial support part 1317*a* and the second main axial support part 1317*b* along the rotating direction of the roller 134, more precisely, on circumferential lateral surfaces (hereafter, downstream circumferential lateral surface) 1317*a*2 and 1317*b*2 in the rotating direction of the roller 134. This can increase oil film pressure in the main axial support parts 1317*a* and 1317*b*, thereby improving axial support force on a first axial bearing surface BS1 for the roller 134.

An axial depth D21 of the first main axial support part 1317*a* may be shallower than an axial depth D11 of the first main back pressure pocket 1315*a*, and an axial depth D22 of the second main axial support part 1317*b* may be shallower than an axial depth D12 of the second main back pressure pocket 1315*b*. This can increase oil film pressure on the downstream circumferential lateral surface 1317*a*2 of the first main axial support part 1317*a* to be explained later and the downstream circumferential lateral surface 1317*b*2 of the second main axial support part 1317*b*, thereby improving axial support force on the first axial bearing surface BS1 for the roller 134.

The first main axial support part 1317*a* and the second main axial support part 1317*b* may each be provided in plural, and the first main axial support part 1317*a* and the second main axial support part 1317*b* may be formed identically to each other. Since the first main axial support part 1317*a* and the second main axial support part 1317*b* are formed identically to each other as described above, the following description will focus on the first main axial support part 1317*a* and a description for the second main axial support part 1317*b* will be replaced with the description of the first main axial support part 1317*a*.

Referring to FIGS. 5 to 7, each of the first main axial support part 1317*a* according to an embodiment of the present disclosure may be formed in a spiral shape inclined with respect to a radial direction of the roller 134.

Specifically, the first main axial support part 1317*a* may include an upstream circumferential lateral surface 1317*a*1, a downstream circumferential lateral surface 1317*a*2, an outer surface 1317*a*3, and an inner surface 1317*a*4. The upstream circumferential lateral surface 1317*a*1, the downstream circumferential lateral surface 1317*a*2, and the outer surface 1317*a*3 may each form a closed step surface, while the inner surface 1317*a*4 may be open toward the outer circumferential surface 1315*a*1 of the first main back pressure pocket 1315*a*.

A gap between the upstream circumferential lateral surface 1317*a*1 and the downstream circumferential lateral surface 1317*a*2, that is, the circumferential length L21, may be constant along the longitudinal direction of the first main axial support part 1317*a*. This may result in maintaining a constant flow rate of oil in the first main back pressure pocket 1317*a*.

The outer surface 1317*a*3 and the inner surface 1317*a*4 of the first main axial support part 1317*a*, through which a longitudinal center line CL1 of the first main axial support part 1317*a* passes, may be spaced apart from each other in a radial direction. Also, the center of the outer surface 1317*a*3 of the first main axial support part 1317*a* may be located at a downstream side in the rotating direction of the roller 134, compared to the center of the inner surface 1317*a*4 of the first main axial support part 1317*a*. Accordingly, the longitudinal center line CL1 of the first main axial support part 1317*a* may be formed to be inclined with respect to the radial direction, and may be formed to be inclined inward with respect to the rotating direction of the roller 134.

Through this, the first main axial support part 1317*a* is inclined in an oil flow direction, which is formed as the roller 134 rotates, and thus, speed of oil flowing along the first main axial support part 1317*a* becomes faster. Accordingly, at the first main axial support part 1317*a*, oil is concentrated on one lateral (side) surface, that is, the downstream circumferential lateral surface 1317*a*2, resulting in increasing oil film pressure due to an edge effect in the first main axial support part 1317*a*. Through this, the rotational shaft including the roller 134 can be supported more stably in the axial direction.

In addition, the first main axial support part 1317*a* and the second main axial support part 1317*b* may be provided by the same number. For example, the number of first main axial support parts 1317*a* and the number of second main axial support parts 1317*b* may be the same. Accordingly, the oil film pressure can be evenly formed in the first main axial support part 1317*a* and the second main axial support part 1317*b*, thereby suppressing in advance imbalance due to an oil film pressure difference between the first main axial support part 1317*a* and the second main axial support part 1317*b*. This can also facilitate machining of the first main axial support part 1317*a* and the second main axial support part 1317*b*.

Additionally, the first main axial support parts 1317*a* and the second main axial support parts 1317*b* may be formed at equal gaps along the circumferential direction. For example, when it is assumed that a gap between virtual lines passing through the centers of the inner surfaces of the neighboring first main axial support parts 1317*a* based on a rotation center Or of the roller 134 is a first gap G1, and a gap between virtual lines passing through the centers of the inner surfaces of the neighboring second main axial support parts 1317*b* based on the rotation center Or of the roller 134 is a second gap G2, the first gaps G1 and the second gaps G2 may each be formed equally. Accordingly, oil film pressure can be evenly maintained in the first main axial support parts 1317*a* and the second main axial support parts 1317*b*. This can also facilitate machining of the first main axial support parts 1317*a* and the second main axial support parts 1317*b*.

Additionally, the first gap G1 and the second gap G2 may be formed to be equal to each other. Accordingly, the oil film pressure can be evenly formed in the first main axial support part 1317*a* and the second main axial support part 1317*b*, thereby suppressing in advance imbalance due to an oil film pressure difference between the first main axial support part 1317*a* and the second main axial support part 1317*b*. This can also facilitate machining of the first main axial support part 1317*a* and the second main axial support part 1317*b*.

In addition, the first gap G1 may be greater than the circumferential length L21 of the first main axial support part 1317*a*, and the second gap G2 may be greater than the circumferential length L22 of the second main axial support part 1317*b*. This can secure bearing areas on the first main axial support part 1317*a* and the second main axial support part 1317*b*, thereby stably supporting the roller 134.

The first gap G1 may be greater than the circumferential length L21 of the first main axial support part 1317*a*, and the second gap G2 may be greater than the circumferential length L22 of the second main axial support part 1317*b*. This can secure bearing areas on the first main axial support part 1317*a* and the second main axial support part 1317*b*, thereby stably supporting the roller 134.

Additionally, the first main axial support parts 1317*a* and the second main axial support parts 1317*b* may be formed at equal depths along the circumferential direction. For example, the first main axial support parts 1317*a* may have the same first depth D21, and the second main axial support parts 1317*b* may have the same second depth D22. This can facilitate machining of the first main axial support parts 1317*a* and the second main axial support parts 1317*b*. In addition, oil film pressure can be evenly maintained in the first main axial support parts 1317*a* along the circumferential direction, and oil film pressure can also be evenly maintained in the second main axial support parts 1317*b* along the circumferential direction.

The first depth D21 and the second depth D22 may be equal to each other. This can facilitate machining of the first main axial support parts 1317*a* and the second main axial support parts 1317*b*. In addition, oil film pressure can be maintained similarly in the first main axial support part 1317*a* and the second main axial support part 1317*b*.

Additionally, the first main axial support parts 1317*a* and the second main axial support parts 1317*b* may be formed with the same cross-sectional area along the circumferential direction. For example, the first main axial support parts 1317*a* may have the same cross-sectional area A21, and the second main axial support parts 1317*b* may have the same cross-sectional area A22. This can facilitate machining of the first main axial support parts 1317*a* and the second main axial support parts 1317*b*. In addition, oil film pressure can be evenly maintained in the first main axial support parts 1317*a* along the circumferential direction, and oil film pressure can also be evenly maintained in the second main axial support parts 1317*b* along the circumferential direction.

The first cross-sectional area A21 and the second cross-sectional area A22 may be formed to be equal to each other. This can facilitate machining of the first main axial support parts 1317*a* and the second main axial support parts 1317*b*. In addition, oil film pressure can be maintained similarly in the first main axial support part 1317*a* and the second main axial support part 1317*b*.

Meanwhile, as described above, the sub axial support part 1327 disposed on the sub bearing 132 is symmetrical to the main axial support part 1317 with respect to the roller 134, so the basic configuration of the sub axial support part 1327 and the resulting effects will be understood by the description of the main axial support part 1317.

Hereinafter, the operating effects of the axial support parts according to an embodiment of the present disclosure will be described.

That is, oil stored in the inner space 110*a* of the casing 110 is suctioned upward along the oil flow path 125 of the rotational shaft 123. The oil is partially introduced and stored into the first main back pressure pocket 1315*a* and the second main back pressure pocket 1315*b*, and partially introduced and stored into the first sub back pressure pocket 1325*a* and the second sub back pressure pocket 1325*b*.

The oil stored in these back pressure pockets [1315*a*, 1315*b*] and [1325*a*, 1325*b*] flows into the axial support parts 1317 and 1327 connected to the back pressure pockets [1315*a*, 1315*b*] and [1325*a*, 1325*b*], to form wide oil films on the first axial bearing surface BS1 and the second axial bearing surface BS2, thereby effectively lubricating between the main bearing 131 and the roller 134 and between the sub bearing 132 and the roller 134.

In addition, when the vane 1351, 1352, 1353 is slidably inserted into the roller 134, the vane 1351, 1352, 1353 may be excessively drawn from the roller 134 in a partial section depending on the shape of the inner circumferential surface 1332 of the cylinder 133. In this instance, the rear surface 1351*b*, 1352*b*, 1353*b* of the vane 1351, 1352, 1353 may move away from each back pressure pocket [1315*a*, 1315*b*], [1325*a*, 1325*b*], which may lower back pressure with respect to the vane 1351, 1352, 1353. This may cause a jumping phenomenon between the cylinder 133 and the vane 1351, 1352, 1353. Considering this in the related art, a partial section of the outer circumferential surface 1315*a*1, 1315*b*1, (no reference numerals) of the back pressure pocket [1315*a*, 1315*b*], [1325*a*, 1325*b*] may extend toward the outer circumferential surface 1342 of the roller 134, to enlarge a radial width of the back pressure pocket [1315*a*, 1315*b*], [1325*a*, 1325*b*].

However, the back pressure pockets [1315*a*, 1315*b*], [1325*a*, 1325*b*] are formed in the groove shape with a preset depth in the first sliding surface 1311*a* of the main bearing 131 and the second sliding surface 1321*a* of the sub bearing 132. As a result, the back pressure pockets [1315*a*, 1315*b*], [1325*a*, 1325*b*] do not form the substantial axial bearing surfaces BS1 and BS2. As a result, when the back pressure pockets [1315*a*, 1315*b*] and [1325*a*, 1325*b*] are formed widely in the radial direction, the axial support force for the vane 1351, 1352, 1353, which passes through a partial section, for example, near the contact point P1 where the roller 134 is in contact with the cylinder 133 may be weakened.

However, as in an embodiment of the present disclosure, when the axial support parts [1317*a*, 1317*b*], [1327*a*, 1327*b*] extend from the outer circumferential surface of the back pressure pocket [1315*a*, 1315*b*], [1325*a*, 1325*b*], oil of the back pressure pocket [1315*a*, 1315*b*], [1325*a*, 1325*b*] may flow into the axial support parts [1317*a*, 1317*b*], [1327*a*, 1327*b*] to compensate for the axial support force for the vane 1351, 1352, 1353. Accordingly, even if the radial width of the back pressure pocket [1315*a*, 1315*b*], [1325*a*, 1325*b*] is reduced compared to the related art, both axial side surfaces of the vane 1351, 1352, 1353 can be stably supported between the axial support parts [1317*a*, 1317*b*], [1327*a*, 1327*b*] extending from the outer circumferential surface of the back pressure pocket [1315*a*, 1315*b*], [1325*a*, 1325*b*].

In particular, by securing the axial bearing area near the contact point P1, the axial support force for the vane 1351, 1352, 1353 which passes near the contact point can be improved, so that the vane 1351, 1352, 1353 can be stably supported.

Accordingly, back pressure applied to the vane 1351, 1352, 1353 can be secured while forming the back pressure pocket [1315*a*, 1315*b*], [1325*a*, 1325*b*] to have a small outer diameter, thereby suppressing collision noise and refrigerant leakage due to jumping between the cylinder 133 and the vane 1351, 1352, 1353.

In addition, as in an embodiment of the present disclosure, when the axial support parts [1317*a*, 1317*b*], [1327*a*, 1327*b*] extend from the outer circumferential surface of the back pressure pocket [1315*a*, 1315*b*], [1325*a*, 1325*b*], the axial support force even for the roller 134 as well as the vane 1351, 1352, 1353 can increase, thereby suppressing friction loss and wear between the roller 134 and the bearings 131 and 132.

Referring back to FIGS. 1 and 4, during the operation of the compressor, oil filled in the back pressure pocket [1315*a*, 1315*b*], [1325*a*, 1325*b*] is partially introduced into the axial support parts [1317*a*, 1317*b*], [1327*a*, 1327*b*]. The introduced oil is concentrated on the downstream circumferential lateral surface 1317*a*2, (no reference numeral) of each axial support part [1317*a*, 1317*b*], [1327*a*, 1327*b*] by centrifugal force generated when the roller 134 rotates. Oil film pressure of the oil increases due to an edge effect in the downstream circumferential lateral surface 1317*a*2.

In other words, an axial gap between the axial bearing surfaces BS1 and BS2 which are continuous from the axial support part [1317*a*, 1317*b*], [1327*a*, 1327*b*] is narrower than an axial gap in the axial support part [1317*a*, 1317*b*], [1327*a*, 1327*b*]. Accordingly, oil concentrated on the downstream circumferential lateral surface 1317*a*2 (not denoted) increases internal pressure, that is, oil film pressure, in the axial support part [1317*a*, 1317*b*], [1327*a*, 1327*b*]. Then, axial support force for the upper surface 134*a* and lower surface 134*b* of the roller 134 can increase, so that the rotor 122, the roller 124, and the rotational shaft 123 can be stably supported in the axial direction.

In particular, when the axial support part [1317*a*, 1317*b*], [1327*a*, 1327*b*] is formed to be inclined inward as in an embodiment of the present disclosure, an oil flow speed in the axial support part [1317*a*, 1317*b*], [1327*a*, 1327*b*] can become faster, thereby further increasing the oil film pressure. Through this, the axial support force for the rotational shaft 123 including the roller 134 and the rotor 122 can be further improved, allowing the rotational shaft 123 to be supported more stably.

In addition, as the axial support parts [1317*a*, 1317*b*], [1327*a*, 1327*b*] according to an embodiment of the present disclosure are formed to be inclined inward, the oil introduced into the axial support parts [1317*a*, 1317*b*], [1327*a*, 1327*b*] flows in a direction to return to the back pressure pockets [1315*a*, 1315*b*], [1325*a*, 1325*b*]. This can suppress fine foreign substances contained in oil from being introduced into the axial bearing surfaces BS1 and BS2 or/and the compression space V over the axial support parts [1317*a*, 1317*b*], [1327*a*, 1327*b*] (or the back pressure pockets). Through this, friction loss and wear caused by foreign substances on the axial bearing surfaces BS1 and BS2 or/and in the compression space V can be suppressed.

Furthermore, when the main axial support part 1317 is formed on the main bearing 131, the sub axial support part 1327 is formed on the sub bearing 132, and the main axial support part 1317 and the sub axial support part 1327 act in opposite directions, the axial movement of the rotational shaft 123 including the roller 134 and the rotor 122 can be stably restricted, thereby effectively suppressing friction loss and wear between the roller 134 and the both bearings 131 and 132.

Hereinafter, a description will be given of another embodiment of the axial support part.

That is, in the previous embodiment, the first gap between the first main axial support parts and the second gap between the second main axial support parts are formed to be the same, but in some cases, a gap between the first main axial support parts and a gap between the second main axial support parts may be formed to be different from each other. This also applies to the sub axial support part.

Figure 8:
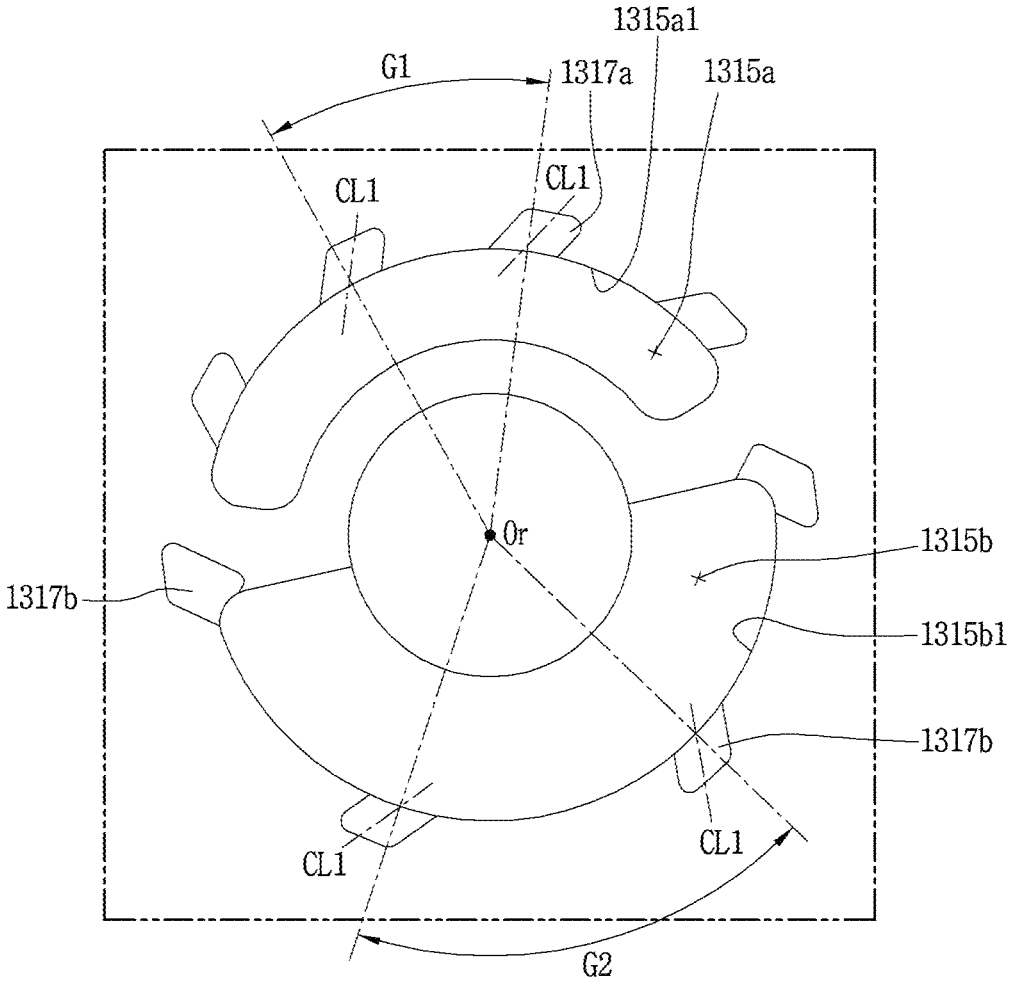
FIG. 8 is a planar view illustrating another embodiment of the axial support part.

FIG. 8 is a planar view illustrating another embodiment of an axial support part.

Referring to FIG. 8, the main axial support parts 1317 according to an embodiment of the present disclosure may include a first main axial support part 1317*a* extending from the first main back pressure pocket 1315*a* and a second main axial support part 1317*b* extending from the second main back pressure pocket 1315*b*. The first main axial support part 1317*a* and the second main axial support part 1317*b* may be provided in plurality, respectively, at preset gaps along the circumferential direction. The first main axial support part 1317*a* and the second main axial support part 1317*b* may be formed in a spiral shape inclined with respect to the radial direction of the roller 134. Since the specific shapes of the first main axial support part 1317*a* and the second main axial support part 1317*b* are the same as those in the previous embodiment, a detailed description thereof will be replaced with the description of the previous embodiment.

However, the main axial support parts 1317 according to this embodiment may be formed at different gaps along the circumferential direction. For example, the same first gap G1 may be set between the first main axial support parts 1317*a* neighboring to each other in the circumferential direction, and the same second gap G1 may be set between the second main axial support parts 1317*b* neighboring to each other in the circumferential direction. However, the first gap G1 between the first main axial support parts 1317*a* forming a low-pressure side (intermediate pressure) may be narrower than the second gap G2 between the second main axial support parts 1317*b* forming a high-pressure side (discharge pressure). The resulting effects may be similar to those in the embodiment of FIG. 5. In other words, oil film pressure in the first main axial support part 1317*a* may be higher than oil film pressure in the second main axial support part 1317*b*. Accordingly, the oil film pressure formed along the circumferential direction of the roller 134 can be almost constant, thereby effectively suppressing tilting of the roller 134. Through this, friction loss and wear between the roller 134 and the main bearing 131 can be suppressed.

Also, even in this case, the first gap G1 may be greater than the circumferential length L21 of the first main axial support part 1317*a*, and the second gap G2 may be greater than the circumferential length L22 of the second main axial support part 1317*b*. This can secure bearing areas on the first main axial support part 1317*a* and the second main axial support part 1317*b*, thereby stably supporting the roller 134.

Hereinafter, a description will be given of still another embodiment of the axial support part.

That is, in the previous embodiment, the depth of the first main axial support part and the depth of the second main axial support part are formed to be the same, but in some cases, the depth of the first main axial support part and the depth of the second main axial support part may be formed to be different from each other. This also applies to the sub axial support part.

Figure 9:
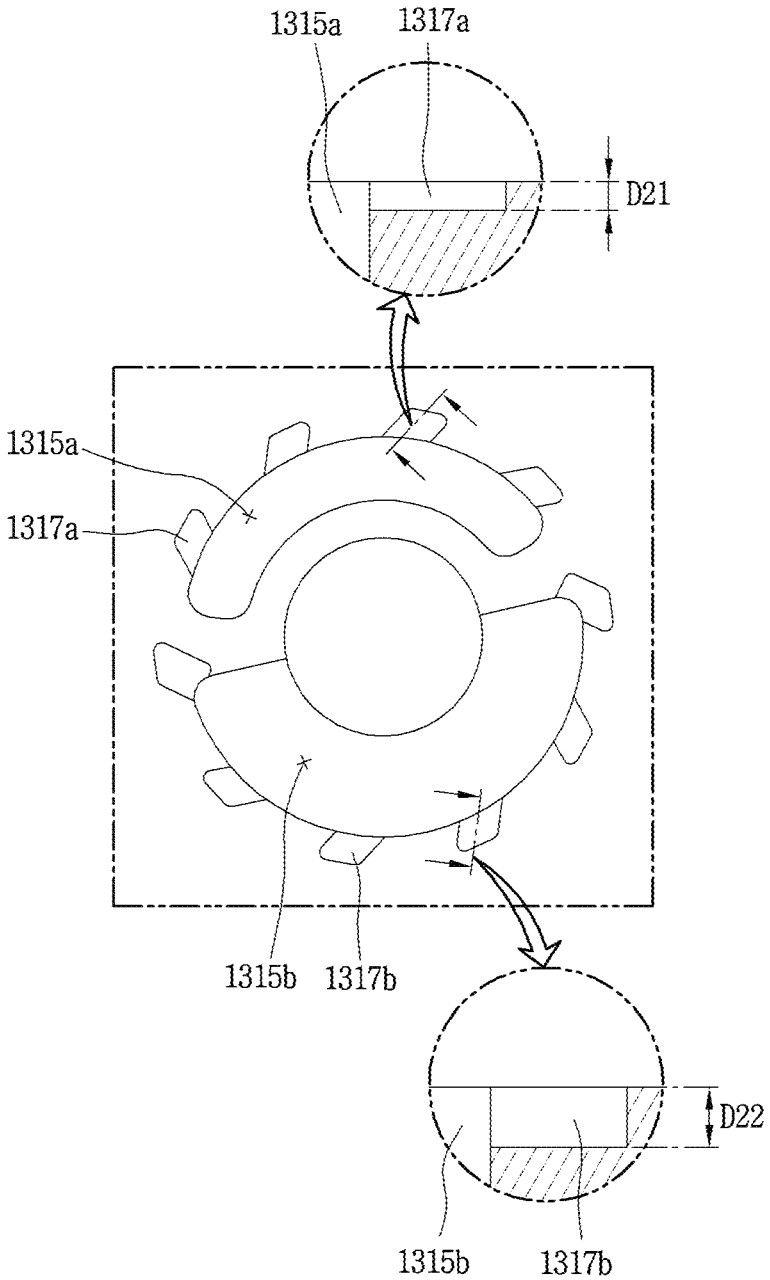
FIG. 9 is an enlarged planar view illustrating still another embodiment of the axial support part.

FIG. 9 is an enlarged planar view illustrating still another embodiment of the axial support part.

Referring to FIG. 9, the main axial support parts 1317 according to an embodiment of the present disclosure may include a first main axial support part 1317*a* extending from the first main back pressure pocket 1315*a* and a second main axial support part 1317*b* extending from the second main back pressure pocket 1315*b*. The first main axial support part 1317*a* and the second main axial support part 1317*b* may be provided in plurality, respectively, at preset gaps along the circumferential direction. The first main axial support part 1317*a* and the second main axial support part 1317*b* may be formed in a spiral shape inclined with respect to the radial direction of the roller 134. Since the specific shapes of the first main axial support part 1317*a* and the second main axial support part 1317*b* are the same as those in the previous embodiment, a detailed description thereof will be replaced with the description of the previous embodiment.

However, the main axial support parts 1317 according to this embodiment may be formed at different depths along the circumferential direction. For example, the first main axial support parts 1317*a* may have the same first depth D21, and the second main axial support parts 1317*b* may have the same second depth D22. However, the first depth D21 of the first main axial support part 1317*a* forming a low-pressure side (intermediate pressure) may be shallower than the second depth D22 of the second main axial support part 1317*b* forming a high-pressure side (discharge pressure). The resulting effects may be similar to those in the embodiment of FIG. 5. In other words, oil film pressure in the first main axial support part 1317*a* may be higher than oil film pressure in the second main axial support part 1317*b*. Accordingly, the oil film pressure formed along the circumferential direction of the roller 134 can be almost constant, thereby effectively suppressing tilting of the roller 134. Through this, friction loss and wear between the roller 134 and the main bearing 131 can be suppressed.

Hereinafter, a description will be given of still another embodiment of the axial support part.

That is, in the previous embodiment, the cross-sectional area of the first main axial support part and the cross-sectional area of the second main axial support part are formed to be the same, but in some cases, the cross-sectional area of the first main axial support part and the cross-sectional area of the second main axial support part may be formed to be different from each other. This also applies to the sub axial support part.

Figure 10:
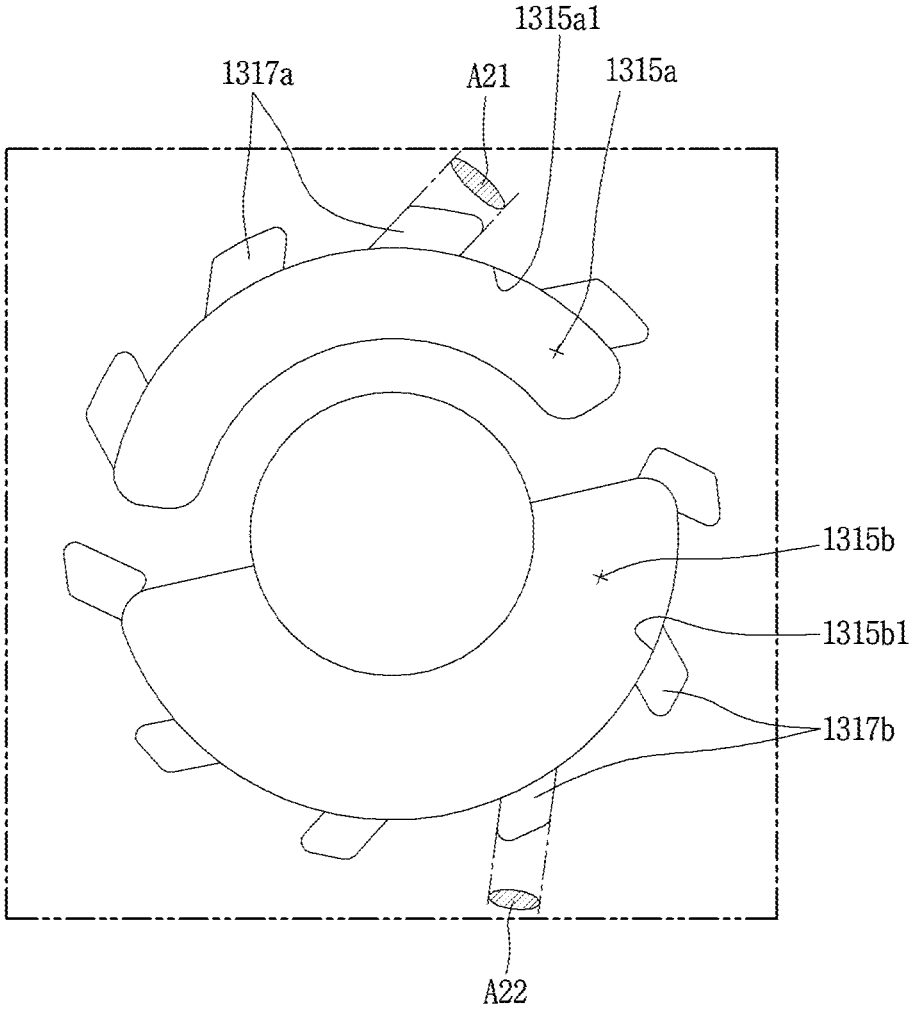
FIG. 10 is an enlarged planar view illustrating still another embodiment for the axial support part.

FIG. 10 is an enlarged planar view illustrating still another embodiment for the axial support part.

Referring to FIG. 10, the main axial support parts 1317 according to an embodiment of the present disclosure may include a first main axial support part 1317*a* extending from the first main back pressure pocket 1315*a* and a second main axial support part 1317*b* extending from the second main back pressure pocket 1315*b*. The first main axial support part 1317*a* and the second main axial support part 1317*b* may be provided in plurality, respectively, at preset gaps along the circumferential direction. The first main axial support part 1317*a* and the second main axial support part 1317*b* may be formed in a spiral shape inclined with respect to the radial direction of the roller 134. Since the specific shapes of the first main axial support part 1317*a* and the second main axial support part 1317*b* are the same as those in the previous embodiment, a detailed description thereof will be replaced with the description of the previous embodiment.

However, the main axial support parts 1317 according to this embodiment may be formed to have different cross-sectional areas along the circumferential direction. For example, the first main axial support parts 1317*a* may have the same cross-sectional area A21, and the second main axial support parts 1317*b* may have the same cross-sectional area A22. However, the first cross-sectional area A21 of the first main axial support part 1317*a* forming a low-pressure side (intermediate pressure) may be smaller than the second cross-sectional area A22 of the second main axial support parts 1317*b* forming a high-pressure side (discharge pressure). The resulting effects may be similar to those in the embodiment of FIG. 5. In other words, oil film pressure in the first main axial support part 1317*a* may be higher than oil film pressure in the second main axial support part 1317*b*. Accordingly, the oil film pressure formed along the circumferential direction of the roller 134 can be almost constant, thereby effectively suppressing tilting of the roller 134. Through this, friction loss and wear between the roller 134 and the main bearing 131 can be suppressed.

Hereinafter, a description will be given of still another embodiment of the axial support part.

That is, the previous embodiments illustrate that the first main axial support part and the second main axial support part are inclined in a linear shape, but in some cases, the first main axial support part and the second main axial support part may be inclined in a curved shape. This also applies to the sub axial support part.

Figure 11:
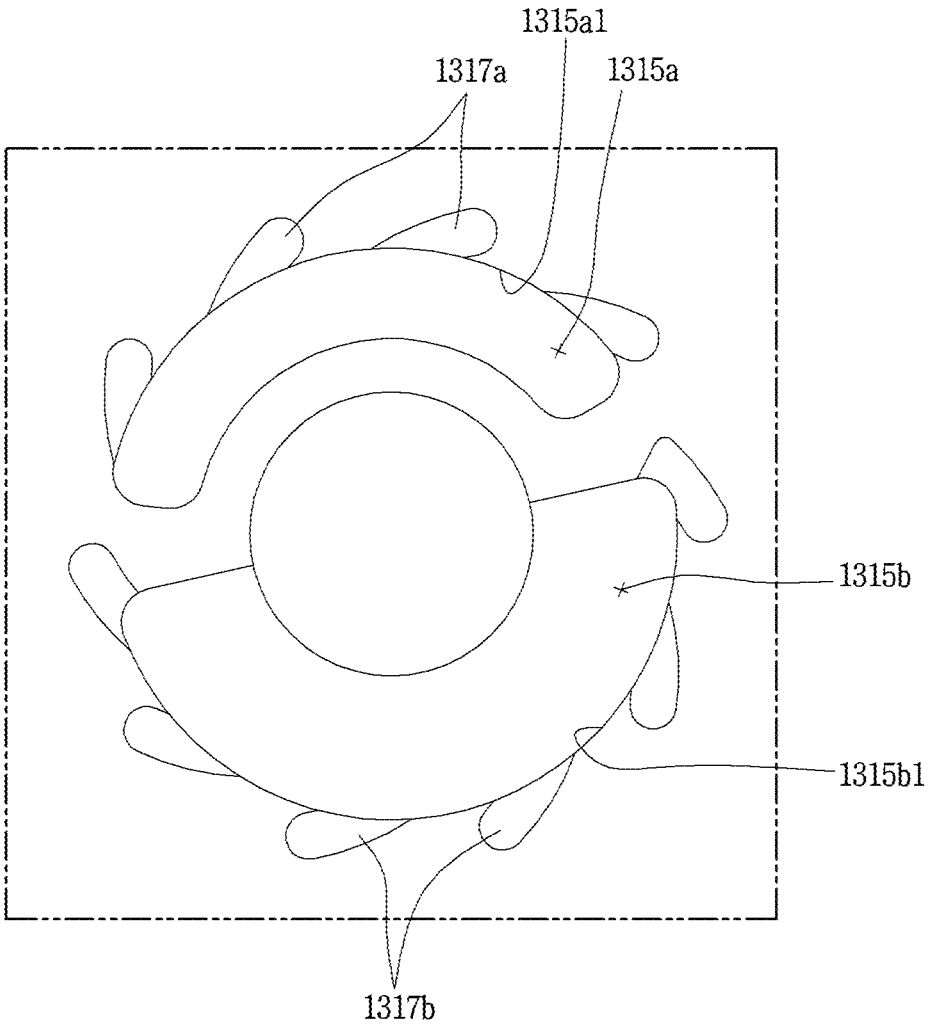
FIG. 11 is an enlarged planar view illustrating still another embodiment for the axial support part.

FIG. 11 is an enlarged planar view illustrating still another embodiment for the axial support part.

Referring to FIG. 11, the main axial support parts 1317 according to an embodiment of the present disclosure may include a first main axial support part 1317*a* extending from the first main back pressure pocket 1315*a* and a second main axial support part 1317*b* extending from the second main back pressure pocket 1315*b*. The first main axial support part 1317*a* and the second main axial support part 1317*b* may be provided in plurality, respectively, at preset gaps along the circumferential direction. The first main axial support part 1317*a* and the second main axial support part 1317*b* may be formed in a spiral shape inclined with respect to the radial direction of the roller 134. Since the specific shapes of the first main axial support part 1317*a* and the second main axial support part 1317*b* are the same as those in the previous embodiment, a detailed description thereof will be replaced with the description of the previous embodiment.

However, the main axial support part 1317 according to this embodiment may be inclined inward to form a forward direction with respect to the rotating direction of the roller 134, and each main axial support part 1317*a*, 1317*b* may be formed in a curved shape. For example, the main axial support part 1317*a*, 1317*b* may be formed in an arcuate shape in which both upstream and downstream circumferential lateral surfaces having a preset curvature.

When the main axial support part 1317*a*, 1317*b* is formed in the curved shape as described above, an oil flow speed can further increase, so that oil film pressure in the main axial support part 1317*a*, 1317*b* can more increase than that in the previous embodiments.

Also, even in this case, the gap between both upstream and downstream circumferential lateral surfaces, that is, the circumferential length L21, L22 of each axial support part 1317*a*, 1317*b* may be equal along the longitudinal direction of the axial support part 1317*a*, 1317*b*, but may be smaller than that in the previous embodiments. Through this, the main axial support parts 1317*a* and 1317*b* can be easily machined.

Additionally, even in this case, since the axial support part 1317*a*, 1317*b* is formed in the curved shape, the friction loss between the edge of the axial support part 1317*a*, 1317*b* and the upper surface 134*a* of the roller 134 can be more effectively reduced.

Hereinafter, a description will be given of still another embodiment of the axial support part.

That is, the previous embodiments illustrate that the first main axial support part and the second main axial support part are inclined inward, but in some cases, the first main axial support part and the second main axial support part may be inclined outward. This also applies to the sub axial support part.

Figure 12:
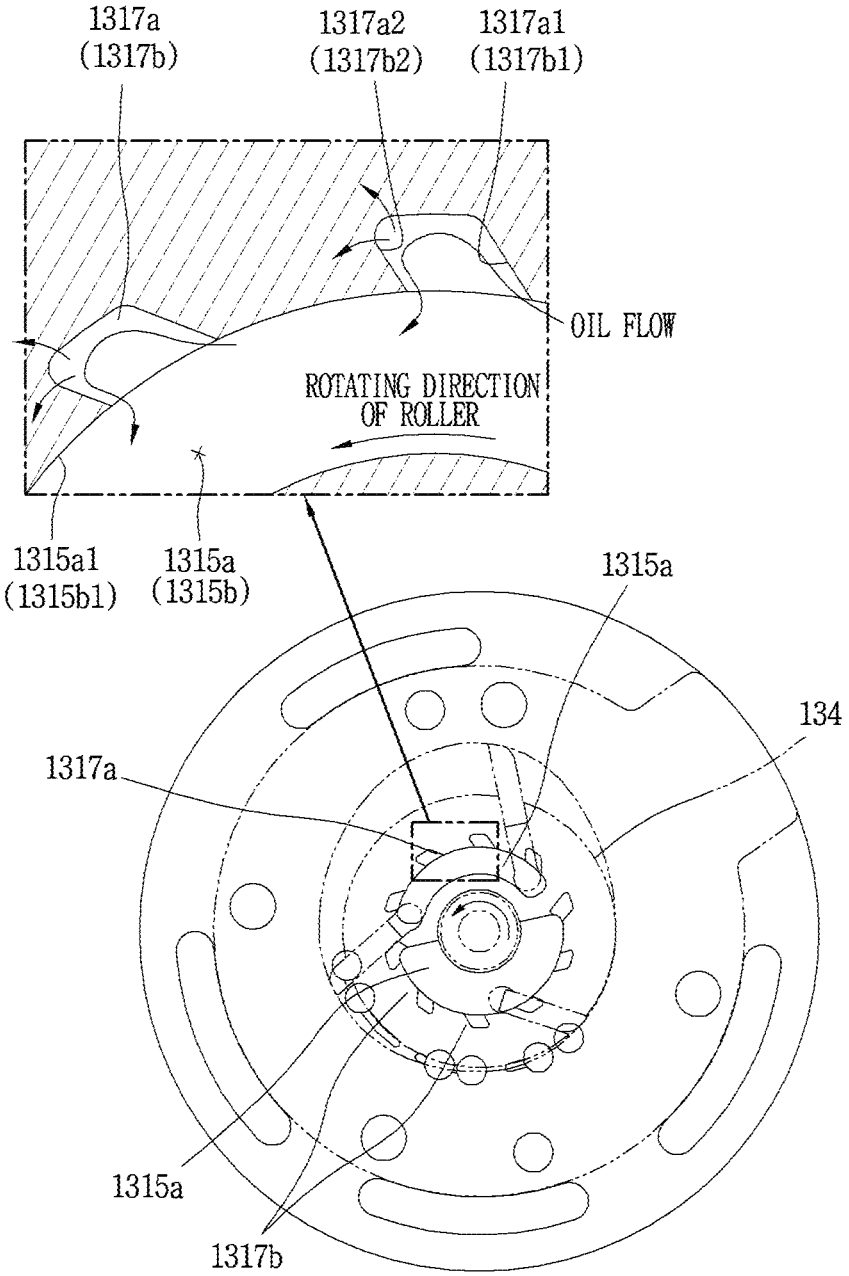
FIG. 12 is a planar view illustrating still another embodiment of the axial support part.

FIG. 12 is a planar view illustrating still another embodiment of the axial support part.

Referring to FIG. 12, the main axial support parts 1317 according to an embodiment of the present disclosure may include a first main axial support part 1317*a* extending from the first main back pressure pocket 1315*a* and a second main axial support part 1317*b* extending from the second main back pressure pocket 1315*b*. The first main axial support part 1317*a* and the second main axial support part 1317*b* may be provided in plurality, respectively, at preset gaps along the circumferential direction. The first main axial support part 1317*a* and the second main axial support part 1317*b* may be formed in a spiral shape inclined with respect to the radial direction of the roller 134. Since the specific shapes of the first main axial support part 1317*a* and the second main axial support part 1317*b* are similar to those in the previous embodiment, a detailed description thereof will be replaced with the description of the previous embodiment.

However, the main axial support part 1317 according to this embodiment may be formed to be inclined outward. For example, the axial support part 1317 according to this embodiment may be provided in plurality formed at preset gaps. Each of the main axial support parts 1317 may also be formed such that the center of the inner surface 1317*a*4 is located at an upstream side, compared to the center of the outer surface 1317*a*3, with respect to the rotating direction of the roller 134. In other words, the outer surface 1317*a*3 and the inner surface 1317*a*4 may be located on opposing sides based on the radial direction of the roller 134. Here, the outer surface 1317*a*3 may be located at a downstream side and the inner surface 1317*a*4 at the upstream side.

When the main axial support part 1317*a*, 1317*b* is formed to be inclined outward as described above, other effects can be obtained in addition to the effects obtained from the inwardly inclined shape described above. For example, when the main axial support part 1317*a*, 1317*b* is formed to be inclined outward, more oil may be concentrated toward the edge between the downstream circumferential lateral surface 1317*a*2 and the outer surface 1317*a*3. This oil can flow over the downstream circumferential lateral surface 1317*a*2 and the outer surface 1317*a*3, thereby improving the lubricating effects for the first axial bearing surfaces BS1 between the main sliding surface 1311*a* of the main bearing 131 and the upper surface of the roller 134 facing the main sliding surface 1311*a*.

In addition, a portion of the oil flowing to the first axial bearing surfaces BS1 between the main sliding surface 1311*a* of the main bearing 131 and the upper surface of the roller 134 facing the main sliding surface 1311*a* flows into the compression space V, to lubricate the vane 1351, 1352, 1353 in the compression space V. This configuration can reduce frictional loss between the main bearing 131 and the roller 134 in the compression space V, thereby improving compressor efficiency.

Hereinafter, a description will be given of still another embodiment of the axial support part.

That is, the previous embodiments illustrate that the first main axial support part and the second main axial support part are inclined with respect to the radial direction of the roller 134, but in some cases, the first main axial support part and the second main axial support part may be radially formed. This also applies to the sub axial support part.

Figure 13:
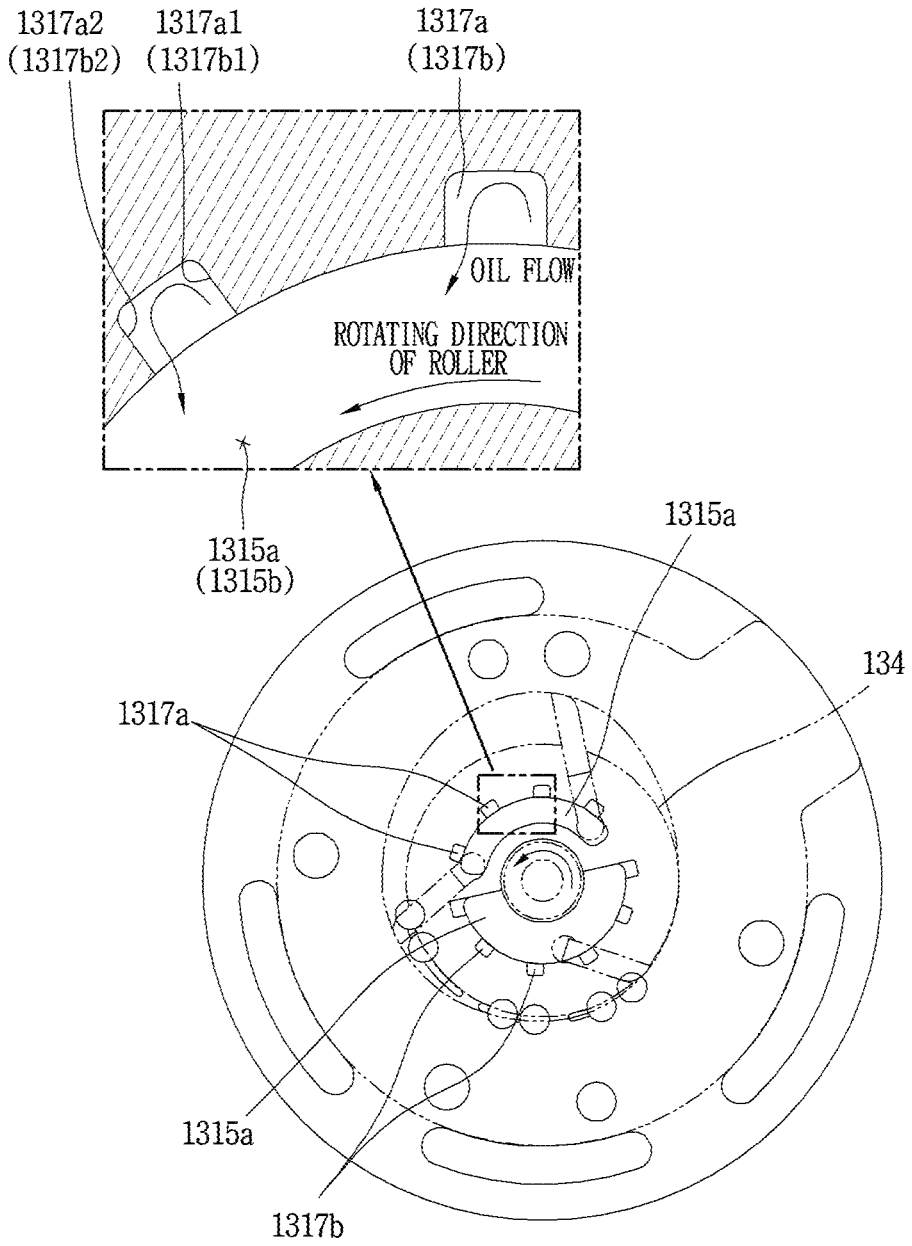
FIG. 13 is a planar view illustrating still another embodiment of the axial support part.

FIG. 13 is a planar view illustrating still another embodiment of the axial support part.

Referring to FIG. 13, the main axial support parts 1317 according to an embodiment of the present disclosure may include a first main axial support part 1317*a* extending from the first main back pressure pocket 1315*a* and a second main axial support part 1317*b* extending from the second main back pressure pocket 1315*b*. The first main axial support part 1317*a* and the second main axial support part 1317*b* may be provided in plurality, respectively, at preset gaps along the circumferential direction. Since the specific shapes of the first main axial support part 1317*a* and the second main axial support part 1317*b* are similar to those in the previous embodiment, a detailed description thereof will be replaced with the description of the previous embodiment.

However, the main axial support part 1317*a*, 1317*b* according to this embodiment may be formed in the radial direction. For example, the main axial support part 1317*a*, 1317*b* according to this embodiment may be provided in plurality formed at preset gaps. Each of the main axial support parts 1317*a*, 1317*b* may also be formed such that the outer surface 1317*a*3, 1317*b*3 and the inner surface 1317*a*4, 1317*b*4 are located at a preset gap along the radial direction of the roller 134.

When the main axial support part 1317*a*, 1317*b* is formed in the radial direction as described above, the effects obtained in the previously described embodiments can be obtained and additionally the main axial support part 1317*a*, 1317*b* can be easily machined. This can facilitate manufacturing of the main bearing 131 while forming the additional axial support parts in the main bearing 131, thereby suppressing an increase in manufacturing cost.

Meanwhile, as described above, in the previous embodiments, the main axial support part 1317 disposed in the main bearing 131 has been described, but the sub axial support part 1327 disposed in the sub bearing 132 may alternatively be formed symmetrically with the main axial support part based on the roller 134. Accordingly, the sub axial support part 1327 will be understood by the description of the main axial support part 1317.

In addition, in the previous embodiments, the main back pressure pocket 1315*a*, 1315*b* and the sub back pressure pocket 1325*a*, 1325*b* are provided in plurality having different pressure, respectively, but in some cases, the main back pressure pocket and the sub back pressure pocket may each be formed in a single ring or arcuate shape. In this case as well, the axial support parts described above may be disposed in each back pressure pocket, and these axial support parts may be applied in the same manner as those in the previous embodiments.

The invention claimed is:

1. A rotary compressor, comprising:

a casing;

a cylinder that is disposed in an inner space of the casing to define a compression space;

a roller that is disposed on a rotational shaft and configured to be rotatable in the inner space of the cylinder;

at least one vane that is slidably inserted into at least one vane slot formed in the roller to rotate together with the roller; and a main bearing and a sub bearing respectively disposed on both sides of the cylinder in an axial direction to define the compression space together with the cylinder, wherein at least one of the main bearing or the sub bearing has at least one back pressure pocket formed at a predetermined depth in a sliding surface facing an axial side surface of the roller, wherein at least one axial support portion that extends from an outer circumferential surface of the at least one back pressure pocket is formed at a predetermined depth in the sliding surface, and wherein a circumferential length of the at least one axial support portion is shorter than a circumferential length of the at least one back pressure pocket.

2. The rotary compressor of claim 1, wherein an axial depth of the at least one axial support portion is shallower than an axial depth of the at least one back pressure pocket.

3. The rotary compressor of claim 1, wherein the at least one axial support portion comprises a plurality of axial support portions provided along a circumferential direction of the roller, and wherein the plurality of axial support portions is formed with equal gaps therebetween along the circumferential direction of the roller.

4. The rotary compressor of claim 1, wherein the at least one axial support portion comprises a plurality of axial support portions provided along a circumferential direction of the roller, and wherein at least some of the plurality of axial support portions is formed with different gaps therebetween along the circumferential direction of the roller.

5. The rotary compressor of claim 4, wherein the at least one back pressure pocket includes a high-pressure side back pressure pocket and a low-pressure side back pressure pocket spaced apart from each other in the circumferential direction, and wherein a first gap between axial support portions of the plurality of axial support portions extending from the high-pressure side back pressure pocket is narrower than a second gap between axial support portions of the plurality of axial support portions extending from the low-pressure side back pressure pocket.

6. The rotary compressor of claim 1, wherein the at least one axial support portion comprises a plurality of axial support portions disposed along a circumferential direction of the roller, and wherein the plurality of axial support portions have a same cross-sectional area along the circumferential direction of the roller.

7. The rotary compressor of claim 1, wherein the at least one axial support portion comprises a plurality of axial support portions disposed along a circumferential direction of the roller, and wherein at least some of the plurality of axial support portions have different cross-sectional areas in the circumferential direction of the roller.

8. The rotary compressor of claim 7, wherein the at least one back pressure pocket includes a high-pressure side back pressure pocket and a low-pressure side back pressure pocket spaced apart from each other in the circumferential direction, wherein the at least one axial support portion comprises a plurality of axial support portions and wherein a second cross-sectional area of at least one axial support portion of the plurality of axial support portions extending from the high-pressure side back pressure pocket is smaller than a first cross-sectional area of at least one axial support portion of the plurality of axial support portions extending from the low-pressure side back pressure pocket.

9. The rotary compressor of claim 1, wherein a back pressure chamber is further defined in the roller and extends from the at least one vane slot to overlap the at least one back pressure pocket in the axial direction, wherein a width of the back pressure chamber is wider than a width of the at least one vane slot, and wherein the at least one back pressure pocket is formed such that an outer circumferential surface thereof passes between the at least one vane slot and the at least one back pressure chamber.

10. The rotary compressor of claim 1, wherein the at least one axial support portion includes lateral surfaces in a circumferential direction, an outer surface that connects a first end of each of the lateral surfaces, and an inner surface that connects a second end of each of the lateral surfaces, wherein the lateral surfaces and the outer surface are stepped, wherein the inner surface is open to an outer circumferential surface of the at least one back pressure pocket to communicate with the at least one back pressure pocket, and wherein both of the lateral surfaces are formed in a linear shape.

11. The rotary compressor of claim 1, wherein the at least one axial support portion includes lateral surfaces in a circumferential direction, an outer surface that connects a first end of each of the lateral surfaces, and an inner surface that connects a second end of each of the lateral surfaces, wherein the lateral surfaces and the outer surface are stepped, wherein the inner surface is open to an outer circumferential surface of the at least one back pressure pocket to communicate with the at least one back pressure pocket, and wherein both of the lateral surfaces are formed in a curved shape.

12. The rotary compressor of claim 1, wherein the at least one axial support portion is inclined inward with respect to a rotational direction of the roller.

13. The rotary compressor of claim 1, wherein the at least one axial support portion is inclined outward with respect to a rotational direction of the roller.

14. The rotary compressor of claim 1, wherein the at least one axial support portion extends in a radial direction with respect to a center of the roller.

15. A rotary compressor, comprising:

a casing;

a cylinder that is disposed in an inner space of the casing to define a compression space;

a roller that is disposed on a rotational shaft and configured to be rotatable in the inner space of the cylinder;

at least one vane that is slidably inserted into at least one vane slot formed in the roller to rotate together with the roller; and a main bearing and a sub bearing respectively disposed on both sides of the cylinder in an axial direction to define the compression space together with the cylinder, wherein at least one of the main bearing or the sub bearing has at least one back pressure pocket formed at a predetermined depth in a sliding surface facing an axial side surface of the roller, and wherein a plurality of axial support portions is formed in the sliding surface, each of the plurality of axial support potions being a groove that extends from an outer circumferential surface of the at least one back pressure pocket.

16. The rotary compressor of claim 15, wherein a circumferential length of each of the groove is shorter than a circumferential length of the at least one back pressure pocket.

17. The rotary compressor of claim 15, wherein an axial depth of each of the groove is shallower than an axial depth of the at least one back pressure pocket.

18. The rotary compressor of claim 15, wherein the plurality of axial support portions is formed with equal gaps therebetween along the circumferential direction of the roller.

19. The rotary compressor of claim 15, wherein the at least one back pressure pocket includes a high-pressure side back pressure pocket and a low-pressure side back pressure pocket spaced apart from each other in the circumferential direction, and wherein a first gap between axial support portions of the plurality of axial support portions extending from the high-pressure side back pressure pocket is greater than a second gap between axial support portions of the plurality of axial support portions extending from the low-pressure side back pressure pocket.

20. The rotary compressor of claim 15, wherein each of the groove has a same cross-sectional area along a circumferential direction of the roller.

21. The rotary compressor of claim 15, wherein the at least one back pressure pocket includes a high-pressure side back pressure pocket and a low-pressure side back pressure pocket spaced apart from each other in the circumferential direction, wherein the at least one axial support portion comprises a plurality of axial support portions and wherein a first cross-sectional area of at least one axial support portion of the plurality of axial support portions extending from the high-pressure side back pressure pocket is smaller than a second cross-sectional area of at least one axial support portion of the plurality of axial support portions extending from the low-pressure side back pressure pocket.

22. The rotary compressor of claim 15, wherein the plurality of axial support portions is inclined with respect to a rotational direction of the roller.

23. The rotary compressor of claim 15, wherein the plurality of axial support portions extends in a radial direction with respect to a center of the roller.

* * * * *